US006212495B1

(12) United States Patent
Chihara

(10) Patent No.: US 6,212,495 B1
(45) Date of Patent: Apr. 3, 2001

(54) CODING METHOD, CODER, AND DECODER PROCESSING SAMPLE VALUES REPEATEDLY WITH DIFFERENT PREDICTED VALUES

(75) Inventor: Keiichi Chihara, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 09/167,991

(22) Filed: Oct. 8, 1998

(30) Foreign Application Priority Data

Jun. 8, 1998 (JP) ..... 10-159467

(51) Int. Cl.[7] ..... G10L 19/00; G10L 19/04

(52) U.S. Cl. ..... 704/221; 704/222; 704/223; 704/230

(58) Field of Search ..... 704/219, 220, 704/221, 222, 223, 224, 230; 375/240

(56) References Cited

U.S. PATENT DOCUMENTS 5,826,226 * 10/1998 Ozawa ..... 704/223
5,963,896 * 10/1999 Ozawa ..... 704/219
5,963,898 * 10/1999 Navarro et al. ..... 704/220
5,970,442 * 10/1999 Timner ..... 704/219
5,999,899 * 12/1999 Robinson ..... 704/222
6,009,388 * 12/1999 Ozawa ..... 704/223
6,073,092 * 6/2000 Kwon ..... 704/219

OTHER PUBLICATIONS

"Adaptive Quantization With a One–Word Memory"; N.S. Jayant; The Bell System Technical Journal; vol. 52, No. 7, Sep., 1973.

* cited by examiner

*Primary Examiner*—David Hudspeth
*Assistant Examiner*—Susan Wieland
(74) *Attorney, Agent, or Firm*—Venable; Robert J. Frank; Allen Wood

(57) ABSTRACT

A differential pulse-code modulation coder obtains an improved signal-to-noise ratio, with only a small increase in bit rate, by repetitive coding. In one aspect, the coder divides the input signal into frames, codes each frame repeatedly using different prediction coefficients or different quantizing step functions, and selects the coefficient or step function that produces the least quantization error. In another aspect, the coder repeats the coding of individual samples located in the outermost steps of the quantizing step function.

33 Claims, 15 Drawing Sheets

FIG.10A

| S(m) / L(m,n) | M(L(m,n)) | | | | | | | |
|---|---|---|---|---|---|---|---|---|
| | 0000 | 0001 | 0010 | 0011 | 0100 | 0101 | 0110 | 0111 |
| 0111 | 2.4 | 2.8 | 2.0 | 2.0 | 2.0 | 2.0 | 2.0 | 1.6 |
| 0110 | 2.0 | 2.4 | 1.6 | 1.6 | 1.6 | 1.6 | 1.6 | 1.2 |
| 0101 | 1.6 | 2.0 | 1.2 | 1.2 | 1.2 | 1.2 | 1.2 | 0.9 |
| 0100 | 1.2 | 1.6 | 0.9 | 0.9 | 0.9 | 0.9 | 1.2 | 0.9 |
| 0011 | 0.9 | 1.2 | 0.9 | 0.9 | 0.9 | 0.9 | 0.9 | 0.9 |
| 0010 | 0.9 | 0.9 | 0.9 | 0.9 | 0.9 | 0.9 | 0.9 | 0.9 |
| 0001 | 0.9 | 0.9 | 0.9 | 0.9 | 0.9 | 0.9 | 0.9 | 0.9 |
| 0000 | 0.9 | 0.9 | 0.9 | 0.9 | 0.9 | 0.9 | 0.9 | 0.9 |
| 1000 | 0.9 | 0.9 | 0.9 | 0.9 | 0.9 | 0.9 | 0.9 | 0.9 |
| 1001 | 0.9 | 0.9 | 0.9 | 0.9 | 0.9 | 0.9 | 0.9 | 0.9 |
| 1010 | 0.9 | 0.9 | 0.9 | 0.9 | 0.9 | 0.9 | 0.9 | 0.9 |
| 1011 | 0.9 | 1.2 | 0.9 | 0.9 | 0.9 | 0.9 | 0.9 | 0.9 |
| 1100 | 1.2 | 1.6 | 0.9 | 0.9 | 0.9 | 0.9 | 1.2 | 0.9 |
| 1101 | 1.6 | 2.0 | 1.2 | 1.2 | 1.2 | 1.2 | 1.2 | 0.9 |
| 1110 | 2.0 | 2.4 | 1.6 | 1.6 | 1.6 | 1.6 | 1.6 | 1.2 |
| 1111 | 2.4 | 2.8 | 2.0 | 2.0 | 2.0 | 2.0 | 2.0 | 1.6 |

FIG.10B

| S(m) / L(m,n) | M(L(m,n)) | | | | | | | |
|---|---|---|---|---|---|---|---|---|
| | 1000 | 1001 | 1010 | 1011 | 1100 | 1101 | 1110 | 1111 |
| 0111 | 1.6 | 1.6 | 1.6 | 1.6 | 1.2 | 1.2 | 1.6 | 1.6 |
| 0110 | 1.2 | 1.2 | 1.2 | 1.6 | 0.9 | 1.2 | 1.6 | 1.6 |
| 0101 | 0.9 | 0.9 | 1.2 | 1.2 | 0.9 | 0.9 | 1.2 | 1.2 |
| 0100 | 0.9 | 0.9 | 0.9 | 1.2 | 0.9 | 0.9 | 1.2 | 1.2 |
| 0011 | 0.9 | 1.2 | 0.9 | 0.9 | 0.9 | 0.9 | 0.9 | 0.9 |
| 0010 | 0.9 | 0.9 | 0.9 | 0.9 | 0.9 | 0.9 | 0.9 | 0.9 |
| 0001 | 0.9 | 0.9 | 0.9 | 0.9 | 0.9 | 0.9 | 0.9 | 0.9 |
| 0000 | 0.9 | 0.9 | 0.9 | 0.9 | 0.9 | 0.9 | 0.9 | 0.9 |
| 1000 | 0.9 | 0.9 | 0.9 | 0.9 | 0.9 | 0.9 | 0.9 | 0.9 |
| 1001 | 0.9 | 0.9 | 0.9 | 0.9 | 0.9 | 0.9 | 0.9 | 0.9 |
| 1010 | 0.9 | 0.9 | 0.9 | 0.9 | 0.9 | 0.9 | 0.9 | 0.9 |
| 1011 | 0.9 | 1.2 | 0.9 | 0.9 | 0.9 | 0.9 | 0.9 | 0.9 |
| 1100 | 0.9 | 0.9 | 0.9 | 1.2 | 0.9 | 0.9 | 1.2 | 1.2 |
| 1101 | 0.9 | 0.9 | 1.2 | 1.2 | 0.9 | 0.9 | 1.2 | 1.2 |
| 1110 | 1.2 | 1.2 | 1.2 | 1.6 | 0.9 | 1.2 | 1.6 | 1.6 |
| 1111 | 1.6 | 1.6 | 1.6 | 1.6 | 1.2 | 1.2 | 1.6 | 1.6 |

CODING METHOD, CODER, AND DECODER PROCESSING SAMPLE VALUES REPEATEDLY WITH DIFFERENT PREDICTED VALUES

BACKGROUND OF THE INVENTION

The present invention relates to a coding method and coder of the type that compresses an input signal, such as a digital audio signal, by coding the difference between the input signal and a predicted signal, and to a corresponding decoder.

Coders of this type compress digital audio signals by exploiting the strong correlation between nearby samples of the signal. Two well-known examples of this coding method, both of which can be implemented with comparatively simple processing, are differential pulse-code modulation (DPCM) and adaptive differential pulse-code modulation (ADPCM). In these coding methods, the predicted value of each sample is the decoded value of the preceding sample.

DPCM employs a quantizer with a fixed step size. As a result, overload noise is perceived when the input signal level is high, because the coder is lacks sufficient bits to encode the signal, and granular noise is perceived when the signal level is low, because the step size is too large in relation to the signal level. In ADPCM, the step size is varied as the input signal level varies, and the perceived amount of these two types of quantization noise is reduced.

The sensitivity of the human ear to quantization noise is comparatively high at low sound levels, and comparatively low at high sound levels. By taking advantage of this property, ADPCM can also reduce the size of the coded data, as compared with DPCM.

At present, ADPCM is used for coding both voice signals, as in the Japanese personal handy-phone system (PHS), and music signals, e.g. for prevention of skipping in portable compact disc (CD) players. In CD applications, sixteen-bit input sample values are compressed to four-bit coded values. This 4:1 compression ratio is not particularly high, but even so, the decoded signal is noticeably inferior to the original signal, because of the effects of quantization noise on high-frequency components (the CD sampling rate of 44.1 kilohertz permits reproduction of even the highest audible frequency components).

The quality of the decoded signal can be improved by using five bits per sample instead of four, but the size of the coded data is then increased by twenty-five percent. There is a need for a coding method that reduces quantization noise without increasing the data size so much.

SUMMARY OF THE INVENTION

An object of the present invention is to reduce quantization noise by adding less than one extra bit per coded sample value to the coded data.

In the invented coding method, each sample of an input signal is coded by the steps of:

(a) calculating a predicted value;

(b) calculating a difference between the sample value and the predicted value;

(c) quantizing the difference, obtaining a quantized value;

(d) coding the quantized value, obtaining coded data; and (e) calculating the predicted value of the next sample from the predicted value and quantized value of the current sample.

For at least one sample, steps (a) to (e) are repeated at least once, using a different predicted value in step (a).

In a first aspect of the invention, the samples are grouped into frames. Steps (a) to (e) are repeated at least once per frame, for all of the samples in the frame. A quantization error is calculated for each repetition. The quantization error may be a total quantization error for all samples in the frame, or a maximum individual-sample quantization error in the frame. For each frame, the coded data obtained in the repetition that produced the least quantization error are output.

In a first sub-aspect of the first aspect, the predicted value of the next sample is obtained by multiplying the sum of the predicted value and quantized value of the current sample by a coefficient. The same coefficient is used throughout each repetition of the coding of an entire frame. Different coefficients are used in different repetitions. Information identifying the coefficient yielding the least quantization error is appended to the coded data for each frame.

In a second sub-aspect of the first aspect, the quantized value is obtained by using a step function selected from a group of step functions. The same step function is used throughout each repetition of the coding of an entire frame. Different step functions are used in different repetitions, leading to different predicted sample values. Information identifying the step function yielding the least quantization error is appended to the coded data for each frame.

In a second aspect of the invention, steps (a) to (e) are repeated for an individual sample whenever the coded data obtained in step (d) represent a maximum absolute quantized value. All repetitions for the same sample are preferably carried out with the same quantization step size in step (c). The predicted value used in each repetition of step (a) preferably differs from the preceding predicted value by less than the maximum absolute quantized value, and forces all of the coded data obtained from all of the repetitions to have the same sign bit. The sign bit is preferably removed from the coded data in all but one of the repetitions.

BRIEF DESCRIPTION OF THE DRAWINGS

In the attached drawings:

FIGS. 10A and 10B constitute a table of multiplier values used in the second embodiment;

DETAILED DESCRIPTION OF THE INVENTION

Embodiments of the invention will be described with reference to the attached illustrative drawings.

Figure 1:
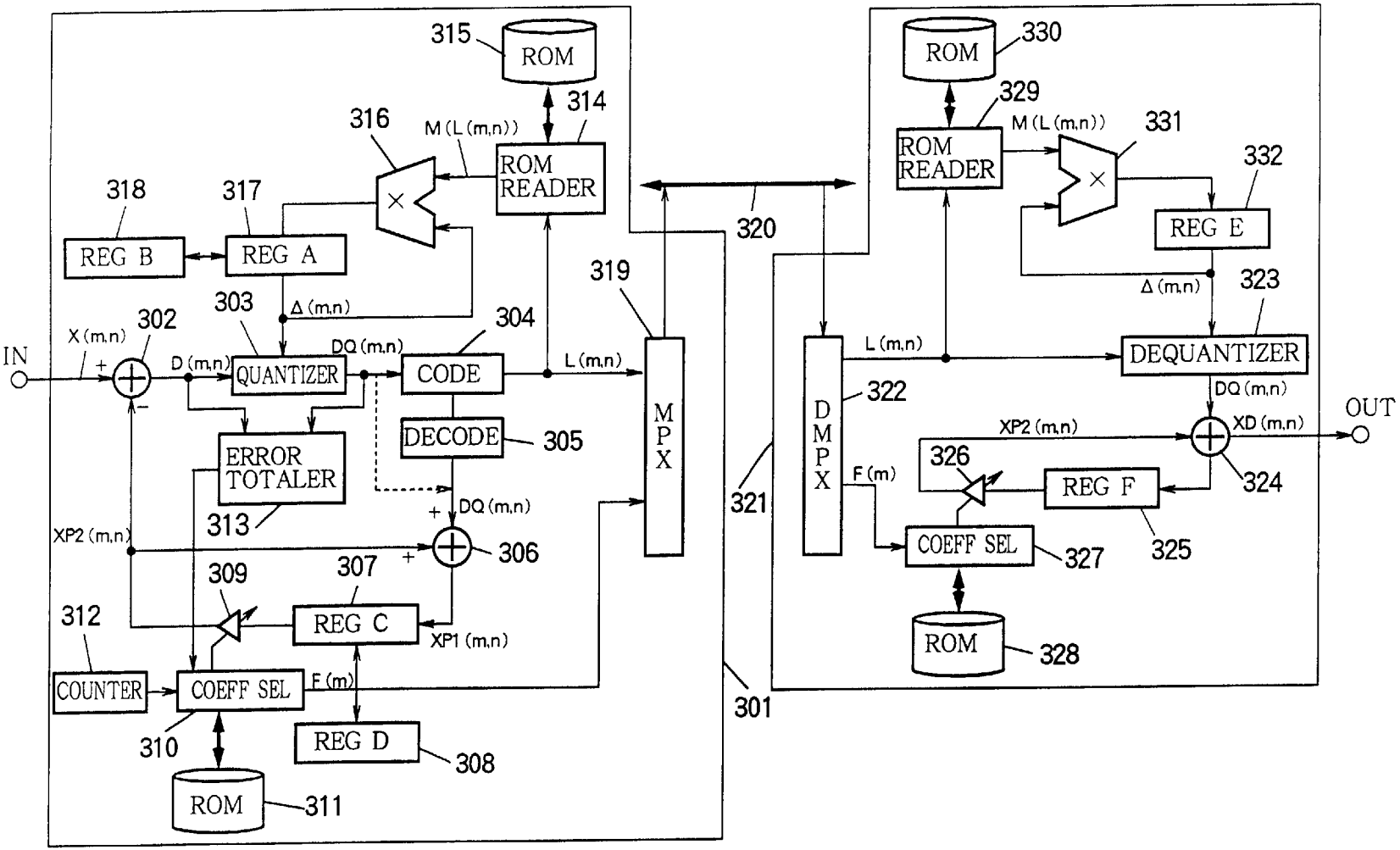
FIG. 1 is a block diagram of a coder and decoder, illustrating a first embodiment of the invention.

FIG. 1 illustrates an ADPCM coder and decoder embodying the first sub-aspect of the first aspect of the invention. The sample values in this embodiment are grouped into frames of ten samples each. In the following description, the current sample value will be the n-th sample in the m-th frame, denoted X(m, n), where m and n are integers.

In the coder 301, an adder 302 takes the difference D(m, n) between the input sample value X(m, n) and a predicted value XP2(m, n), by adding X(m, n) to the two's complement of XP2(m, n). Adder 302 thus functions as a subtractor. A quantizer 303 quantizes the difference D(m, n), using a quantization step size Δ(m, n), to obtain a quantized difference DQ(m, n). A coding unit 304 codes the quantized difference DQ(m, n) to obtain a four-bit coded sample value L(m, n). A decoding unit 305 decodes L(m, n) to recover DQ(m, n). Another adder 306 adds DQ(m, n) to the predicted value XP2(m, n) to obtain a preliminary predicted value XP1(m, n+1) for the next sample, which is stored in a register 307 denoted register (REG) C, replacing an existing preliminary value XF1(m, n). At appropriate times, the contents of register C are saved to another register 308 denoted register D, for subsequent reloading into register C.

Adder 306 receives DQ(m, n) from decoding unit 305, but since this DQ(m, n) is identical to the DQ(m, n) output by quantizer 303, decoding unit 305 can be omitted and DQ(m, n) can be supplied directly from quantizer 303 to adder 306, as indicated by the dotted line. Alternatively, the quantizer 303, coding unit 304, and decoding unit 305 can be combined into a single quantizing and coding unit that obtains both the quantized difference DQ(m, n) and the coded value L(m, n).

The predicted value XP2(m, n) is obtained by a multiplier 309 that multiplies the preliminary value XP1(m, n) stored in register C by a coefficient supplied by a coefficient selector (COEFF SEL) 310. The coefficient selector 310 obtains the coefficient from a group of coefficients stored in a coefficient read-only memory or ROM 311, using a counter 312 to generate addresses for the coefficient ROM 311. An error totaler 313 calculates the total quantization error in each frame from the quantized and unquantized difference values DQ(m, n) and D(m, n) The coefficient selector 310 selects and outputs the address F(m) of the coefficient that gives the least total quantization error for each frame.

Adder 306, registers C and D, and multiplier 309 function as a predictor that uses the predicted value XP2(m, n) of the current sample, the corresponding quantized value DQ(m, n), and the supplied coefficient to predict the value of the next sample.

The counter 312 may be any type of counter that generates at least sixteen different count values. A four-bit counter can be used, for example.

The coded value L(m, n) is supplied to a ROM reader 314 and used as address information to read a value M(L(m, n)) from a multiplier ROM 315. M(L(m, n) is supplied to a multiplier 316, which multiplies the quantization step size Δ(m, n) by M(L (m, n)) to obtain the step size Δ(m, n+1) that will be used for the next sample. This step size Δ(m, n+1) is stored in a register 317 denoted register A, replacing the current step size Δ(m, n), which was supplied from register A to the quantizer 303. At appropriate times, the contents of register A are saved to another register 318 denoted register B, for subsequent reloading into register A.

ROM reader 314, multiplier ROM 315, multiplier 316, and registers A and B function as a step-size modifier that uses the coded value of the current sample to modify the quantization step size for the next sample.

A multiplexer (MPX) 319 multiplexes the coded sample values L(m, n) and coefficient address information F(m) output by the coding unit 304 and coefficient selector 310 onto a communication channel or recording medium 320, from which they are obtained by the decoder 321.

In the decoder 321, L(m, n) and F(m) are demultiplexed by a demultiplexer (DMPX) 322. L(m, n) is supplied to a dequantizer 323 that performs the same function as the decoding unit 305 in the coder 301, obtaining a dequantized difference value DQ(m, n) equal to the quantized difference DQ(m, n) in the coder 301. An adder 324 adds DQ(m, n) to a predicted output value XP2(m, n) to obtain a decoded sample value XD(m, n), equal to XP1(m, n) in the coder, which is output from the decoder 321. The decoded output value XD(m, n) is also stored in a register 325 denoted register F, and multiplied in a multiplier 326 by a coefficient supplied by a coefficient selector 327 to obtain the next predicted output value XP2(m, n+1), which is equal to XP2(m, n+1) in the coder. The coefficient selector 327 obtains the coefficient from a coefficient ROM 328, using the address information F(m).

Adder 324, register F, and multiplier 326 function as an output predictor that uses the dequantized value and predicted value of the current sample to calculate the output value of the current sample, and uses this output value and the coefficient specified for the current frame to predict the output value of the next sample.

The coded sample value L(m, n) is also supplied to a ROM reader 329, which reads data from a multiplier ROM 330 and outputs a multiplier M(L(m, n)) by which the quantization step size Δ(m, n) supplied to the dequantizer 323 is multiplied. This multiplication operation is performed in a multiplier 331, and the result is stored in a register 332 denoted register E. ROM reader 329, multiplier ROM 330, multiplier 331, and register E constitute a step-size modifier.

The two coefficient ROMs 311 and 328 store identical coefficient data, as listed in Table 1. Sixteen coefficient values are stored in each ROM. F(m) in Table 1 denotes the address information input to the ROM, and a(F(m)) is the data output from the ROM.

TABLE 1

Coefficient ROM Contents

| F(m) | a(F(m)) | F(m) | a(F(m)) |
|---|---|---|---|
| 0000 | 56/64 | 1000 | 64/64 |
| 0001 | 57/64 | 1001 | 65/64 |
| 0010 | 58/64 | 1010 | 66/64 |
| 0011 | 59/64 | 1011 | 67/64 |
| 0100 | 60/64 | 1100 | 68/64 |
| 0101 | 61/64 | 1101 | 69/64 |
| 0110 | 62/64 | 1110 | 70/64 |
| 0111 | 63/64 | 1111 | 71/64 |

Since the coefficients multiplied by multipliers 309 and 326 are all of the form k/64, where k is an integer, multipliers 309 and 326 can be configured using bit shifters and adders, enabling the multiplication operations to be carried out at high speed with relatively small hardware requirements. For example, multiplication of a number X by the first coefficient 56/64 (binary 0.111) can be carried out as follows, where X>>j represents the value of X right-shifted by j bits (j=1, 2, 3).

$$(56/64)\times X=X>>1+X>>2+X>>3$$

The two multiplier ROMs 315 and 330 store identical multiplier data, as listed in Table 2. Input of L(m, n) as an address pointer yields output of the corresponding multiplier M(L(m, n)). DQ(M, n) is the quantized or dequantized value corresponding to L(m, n).

TABLE 2

Multiplier ROM Data

| DQ(m, n) | L(m, n) | M(L(m, n)) |
|---|---|---|
| 15Δ(m, n)/8 | 0111 | 2.4 |
| 13Δ(m, n)/8 | 0110 | 2.0 |
| 11Δ(m, n)/8 | 0101 | 1.6 |
| 9Δ(m, n)/8 | 0100 | 1.2 |
| 7Δ(m, n)/8 | 0011 | 0.9 |
| 5Δ(m, n)/8 | 0010 | 0.9 |
| 3Δ(m, n)/8 | 0001 | 0.9 |
| Δ(m, n)/8 | 0000 | 0.9 |
| −Δ(m, n)/8 | 1000 | 0.9 |
| −3Δ(m, n)/8 | 1001 | 0.9 |
| −5Δ(m, n)/8 | 1010 | 0.9 |
| −7Δ(m, n)/8 | 1011 | 0.9 |
| −9Δ(m, n)/8 | 1100 | 1.2 |
| −11Δ(m, n)/8 | 1101 | 1.6 |
| −13Δ(m, n)/8 | 1110 | 2.0 |
| −15Δ(m, n)/8 | 1111 | 2.4 |

The operation of the first embodiment will now be described with reference to the flowcharts in FIGS. 2 and 3.

Figure 2:
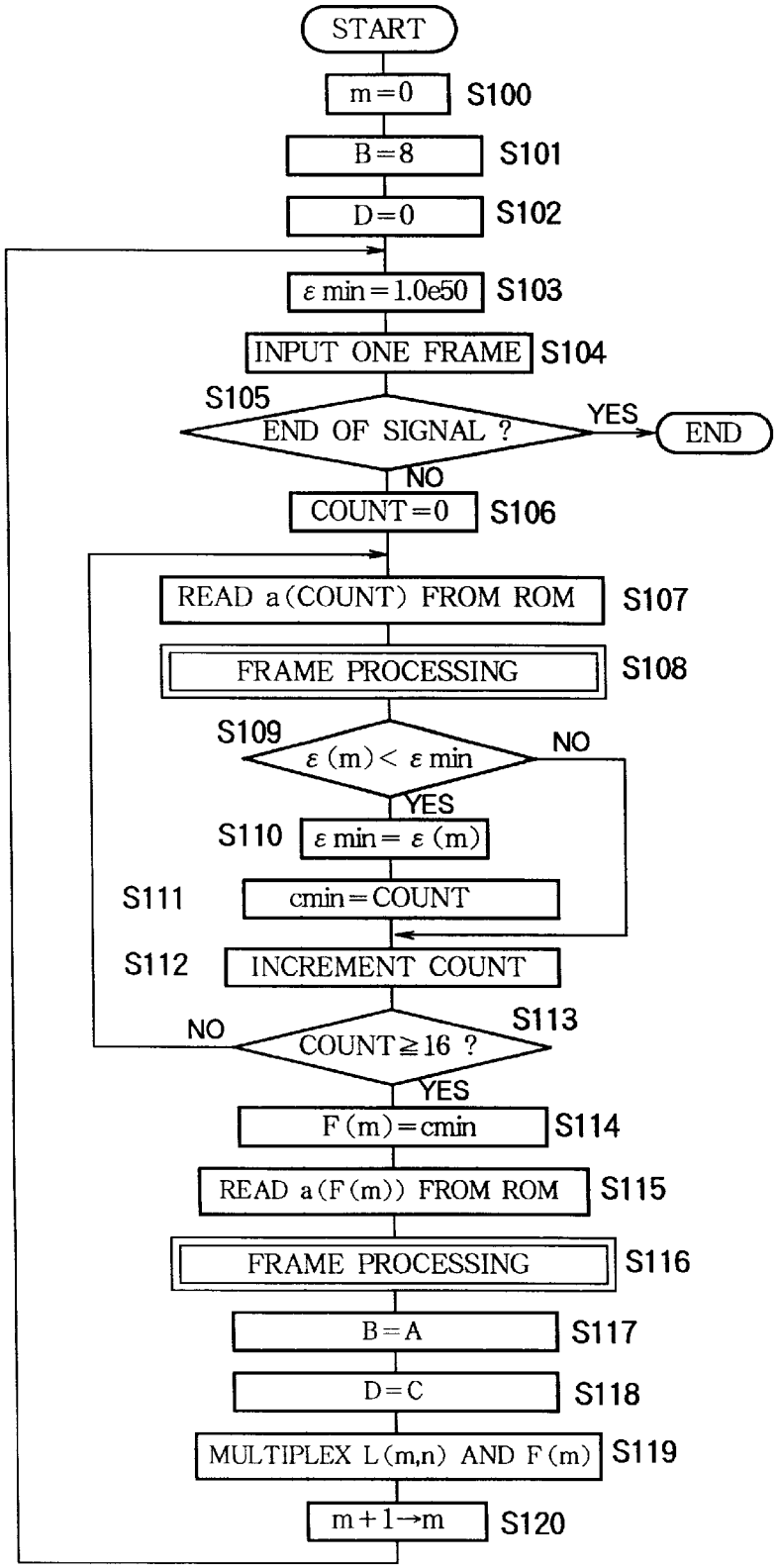
FIG. 2 is a flowchart illustrating the operation of the coder in FIG. 1.

Referring to FIG. 2, the processing of an input signal is preceded by initialization steps S100, S101, and S102, in which the frame number m is set to zero, and initial values of eight and zero are loaded into registers B and D, respectively. The zero placed in register D becomes the predicted value of the first sample in the first frame.

In the next step S103, a minimum-error variable εmin employed in the error totaler 313 is set to a large value, such as $10^{50}$, preferably larger than the largest possible total quantization error per frame. Next, the ten sample values of the current frame are input in step S104 and stored in an input buffer comprising, for example, ten sixteen-bit registers (not shown in the drawings). If step S104 cannot be carried out because the end of the input signal has been reached, this is determined in step S105, and processing of the input signal ends. Otherwise, counter 312 is initialized to zero in step S106.

In step S107, a coefficient a(count) is read from the coefficient ROM 311, using the counter value (count) as an address. In step S108, the entire frame of samples is processed using this coefficient a(count). The frame processing will be described later. In the frame processing, the error totaler 313 obtains the total quantization error ε(m) for the frame, and compares ε(m) with the variable εmin in step S109. If ε(m) is less than εmin, then the value of εmin is changed to ε(m) in step S110, and the coefficient selector 310 sets an internal count variable cmin to the current count value (count) in step S111. If ε(m) is not less than εmin, then steps S110 and S111 are skipped.

Next, counter 312 is incremented in step S112, and the resulting count value is compared with sixteen in step S113. If the count is less than sixteen, the process returns to step S107 to read another coefficient from the coefficient ROM 311 and repeat the processing of the same frame. Incidentally, if counter 312 is a four-bit counter, then sixteen is equivalent to zero, and the decision criterion in step S113 is whether the count is equal to zero.

When the input frame has been processed sixteen times, a 'Yes' decision is made in step S113, and the processing proceeds to step S114, in which the address output F(m) of the coefficient selector 310 is set to the current value of the count variable cmin. In step S115, the corresponding coefficient a(F(m)) is read from the coefficient ROM 311. In step S116, the frame processing is repeated once more, using a(F(m)), and the resulting coded data L(m, n) are supplied to the multiplexer 319. In step S117, the resulting contents of register A are saved into register B. In step S118, the contents of register C are saved into register D. In step S119, the coded data L(m, n) and address information F(m) are multiplexed by the multiplexer 319 onto the communication channel or recording medium 320. In step S120, the frame number m is incremented, and the procedure returns to step S103 to begin processing the next frame.

Figure 3:
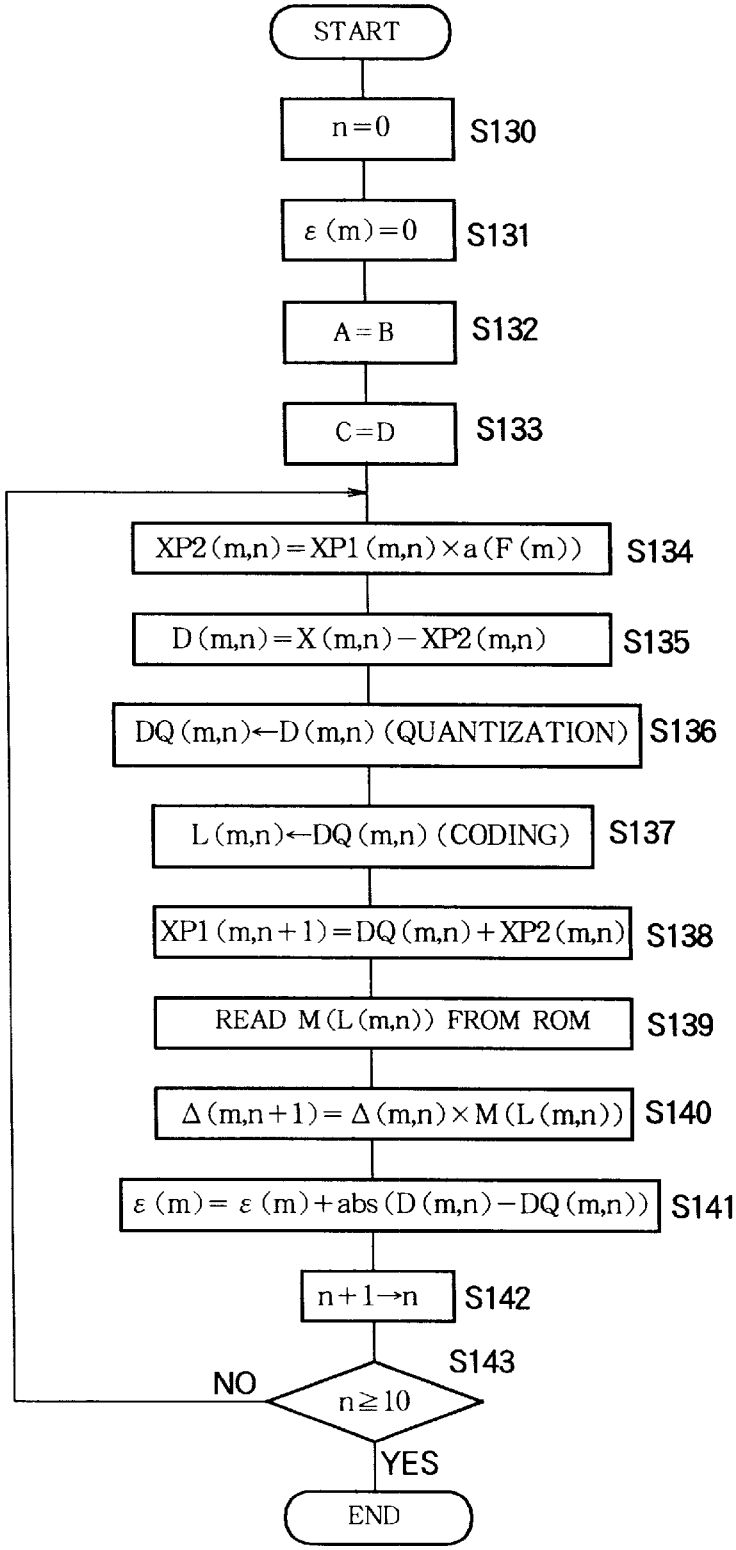
FIG. 3 is a flowchart illustrating the frame processing in FIG. 2.

The frame processing carried out in steps S108 and S116 in FIG. 2 is illustrated in FIG. 3.

In steps S130 and S131, the sample number n and total quantization error ε(m) are both initialized to zero. In steps S132 and S133, the contents of registers B and D are loaded into registers A and C, respectively.

In step S134, the predicted value XP2(m, n) of the current sample is obtained by multiplying the contents XP1(m, n) of register C by the coefficient a(count) or the coefficient a(F(m)). For simplicity, only a(F(m) ) is indicated in the drawing. In step S135, XP2(m, n) is subtracted from the sample value X(m, n) to obtain the difference value D(m, n). In step S136, D(m, n) is quantized to obtain the quantized difference value DQ(m, n).

Figure 4:
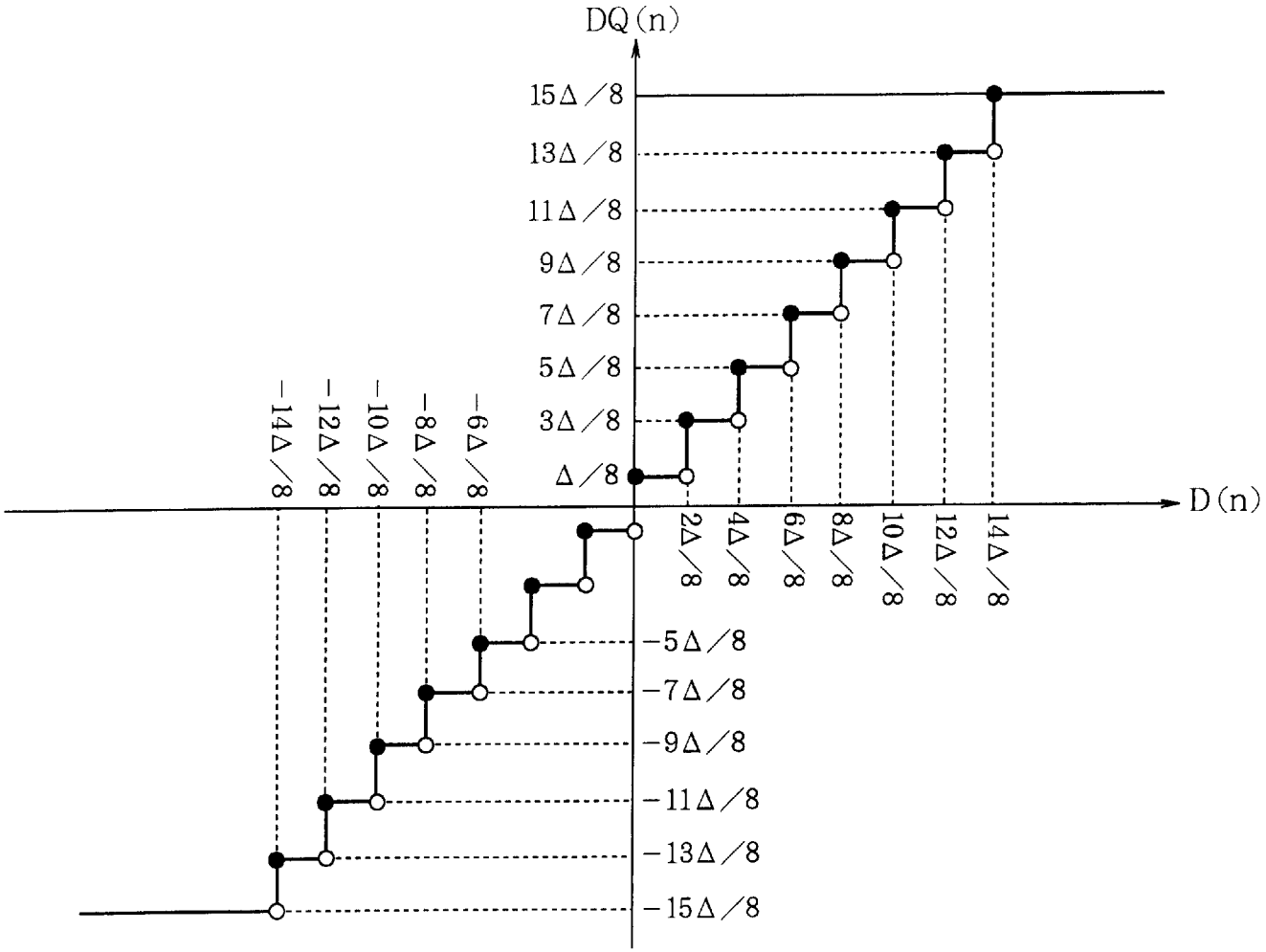
FIG. 4 is a graph illustrating a quantization step function.

The quantizing function is a step function as illustrated in FIG. 4, in which Δ is the step size Δ(m, n). There are sixteen possible quantized values, from −15Δ(m, n)/8 to 15Δ(m, n)/8. The quantization rule is given explicitly by the following equations.

$$DQ(m, n)=15\Delta(m, n)/8 \text{ if } 14\Delta(m, n)/8\leqq D(m, n)$$

$$DQ(m, n)=(2i+1)\Delta(m, n)/8$$

$$\text{if } 2i\Delta(m, n)/8\leqq D(m, n)<(2i+2)\Delta(m, n)/8$$

$$\text{where } -7\leqq i\leqq 6$$

$$DQ(m, n)=-15\Delta(m, n)/8 \text{ if } D(m, n)<-14\Delta(m, n)/8$$

In step S137 in FIG. 3, the quantized value DQ(m, n) is converted to a four-bit coded value L(m, n) according to the correspondence shown in Table 2.

In step S138, the preliminary value XP1(m, n+1) for the next sample is obtained by adding DQ(m, n) and XP2(m, n), and is stored in register C.

In steps S139 and S140, the multiplier value M(L(m, n)) is read from the multiplier ROM 315 and multiplied by the current step size Δ(m, n) to obtain the step size Δ(m, n+1) for the next sample. This step size Δ(m, n+1) is stored in register A.

In step S141, the quantization error total ε(m) is updated by adding the absolute difference between the actual difference value D(m, n) and the quantized value DQ(m, n) This step can be skipped when the frame processing is carried out in step S116 in FIG. 2.

In step S142, the sample number n is incremented. In step S143, the incremented value of n is compared with the number of samples per frame (ten). If n is less than the number of samples per frame, the procedure returns to step S134 to process the next sample. Otherwise, the procedure ends.

At the end of the frame processing in FIG. 3, the total quantization error $\epsilon(m)$ is given by the following equation, in which abs represents absolute value.

$$\varepsilon(m) = \sum_{n=0}^{9} \mathrm{abs}(D(m, n) - DQ(m, n))$$

It is not always necessary to add up all ten terms of this sum. The frame processing in FIG. 3 can be halted as soon as $\epsilon(m)$ exceeds $\epsilon min$, because it is already certain that the decision in step S109 in FIG. 2 will be 'No.'

Steps S109 to S111 in FIG. 2 determine the coefficient that minimizes $\epsilon(m)$. Step S114 assigns the address of this optimum coefficient as the output F(m) of the coefficient selector 310.

The values stored in registers B and D in steps S117 and S118 in FIG. 2 are the following values, which are obtained by processing the frame with the optimum coefficient a(F(m)) found as above.

Register B: $\Delta(m, 9)\times M(L(m, 9))$

Register D: $XP2(m, 9)+DQ(m, 9)$

The values loaded into registers A and C in steps S132 and S133 in FIG. 3 are accordingly the following values, obtained in the processing of the preceding (m−1)-th frame with the optimum coefficient found for the (m−1)-th frame.

Register A: $\Delta(m, 0)=\Delta(m-1, 9)\times M(L(m-1, 9))$

Register C: $XP1(m, 0)=XP2(m-1, 9)+DQ(m-1, 9)$

The decoding process performed by the decoder 321 is analogous to the coding process, except that each frame is processed only once. The initial values placed in registers E and F are eight and zero, matching the initial values in registers A and C in the coder. Registers E and F are not reloaded at the beginning of each frame.

In the decoding process, L(m, n) is dequantized, using the step size $\Delta(m, n)$ stored in register E, to obtain DQ(m, n). The previous output sample data value XD(m, n−1) stored in register F is used as a preliminary predicted value for the current sample. This value XD(m, n−1) is multiplied by the coefficient a(F(m)) read from ROM 328 at address F(m) to obtain the predicted valued XP2(m, n), which is added to DQ(m, n) to produce the output sample data value XD(m, n). This value XD(m, n) is stored in register F as the preliminary prediction for the next sample. In the meantime, the multiplier ROM 330 is read, with L(m, n) as an address, to obtain a multiplier M(L(m, n)), and the current quantization step size $\Delta(m, n)$ is multiplied by M(L(m, n)) to calculate the step size $\Delta(m, n+1)$ for the next sample.

For values of n greater than zero, the following equations describe the decoding process.

$$XP2(m, n)=XD(m, n-1)\times a(F(m))$$

$$\Delta(m, n)=\Delta(m, n-1)\times M(L(m, n-1))$$

$$XD(m, n)=XP2(m, n)+DQ(m, n)$$

When the first sample in a frame is decoded (n =0), the preliminary predicted value stored in register F is the output value of the last sample (n=9) in the preceding frame (m−1), and the step size is also obtained from the preceding frame.

$$XP2(m, 0)=XD(m-1, 9)\times a(F(m))$$

$$\Delta(m, 0)=\Delta(m-1, 9)\times M(L(m-1, 9))$$

The coding process in FIGS. 2 and 3 produces ten four-bit coded sample values L(m, n) and one four-bit address F(m) per frame. The coding rate is accordingly forty-four bits per frame, or 4.4 bits per sample. This rate can be reduced to 4.3 bits per sample by storing only eight coefficients in the coefficient ROMs 311 and 328, so that only three address bits are required in F(m).

The performance of the first embodiment was evaluated objectively by calculating an average segmental signal-to-noise ratio segSNR. Results are listed below for a swept sine-wave input signal varying in frequency from twenty hertz to twenty kilohertz (20 Hz to 20 kHz). The input samples were divided into blocks of two hundred fifty-six samples each, yielding a certain number SB of blocks, and the average signal-to-noise ratio per block was calculated. The signal-to-noise ratio SNR(i) of the i-th block was calculated in decibels (dB) by the following equations.

$$SNR(i)=10\log_{10}(signal_power/noise_power)$$

$$noise_power = \sum_{n=0}^{255} (X(n) - XD(n))^2$$

$$signal_power = \sum_{n=0}^{255} X(n)^2$$

Then segSNR was calculated as follows.

$$segSNR = \sum_{i=0}^{SB} SNR(i)/SB$$

These calculations were performed for the first embodiment described above, for the variation with 4.3 bits per sample, and for conventional four-bit and five-bit ADPCM coders that will be described below. The results are shown in Table 3.

TABLE 3

Comparison of Coder Performance

| Bits per Sample | segSNR |
|---|---|
| 5.0 (conventional coder) | 46.9 dB |
| 4.4 (first embodiment) | 45.7 dB |
| 4.3 (variation) | 45.1 dB |
| 4.0 (conventional coder) | 42.0 dB |

Compared with the conventional four-bit ADPCM coder, the first embodiment yielded an improvement of 3.7 dB, approaching the performance of a conventional five-bit ADPCM coder, with only a ten-percent increase in coded data size. The variation of the first embodiment using eight coefficients and three-bit addresses yielded an improvement of 3.1 dB over the four-bit ADPCM coder with an increase of only 7.5 percent in code size.

The performance of the first embodiment was also evaluated subjectively, using music samples. The audible high-frequency quantization noise produced by conventional four-bit ADPCM was considerably reduced by the first embodiment. The listening quality of the output of the first embodiment was compared with that of conventional five-bit ADPCM, and was judged to be nearly the same.

Figure 5:
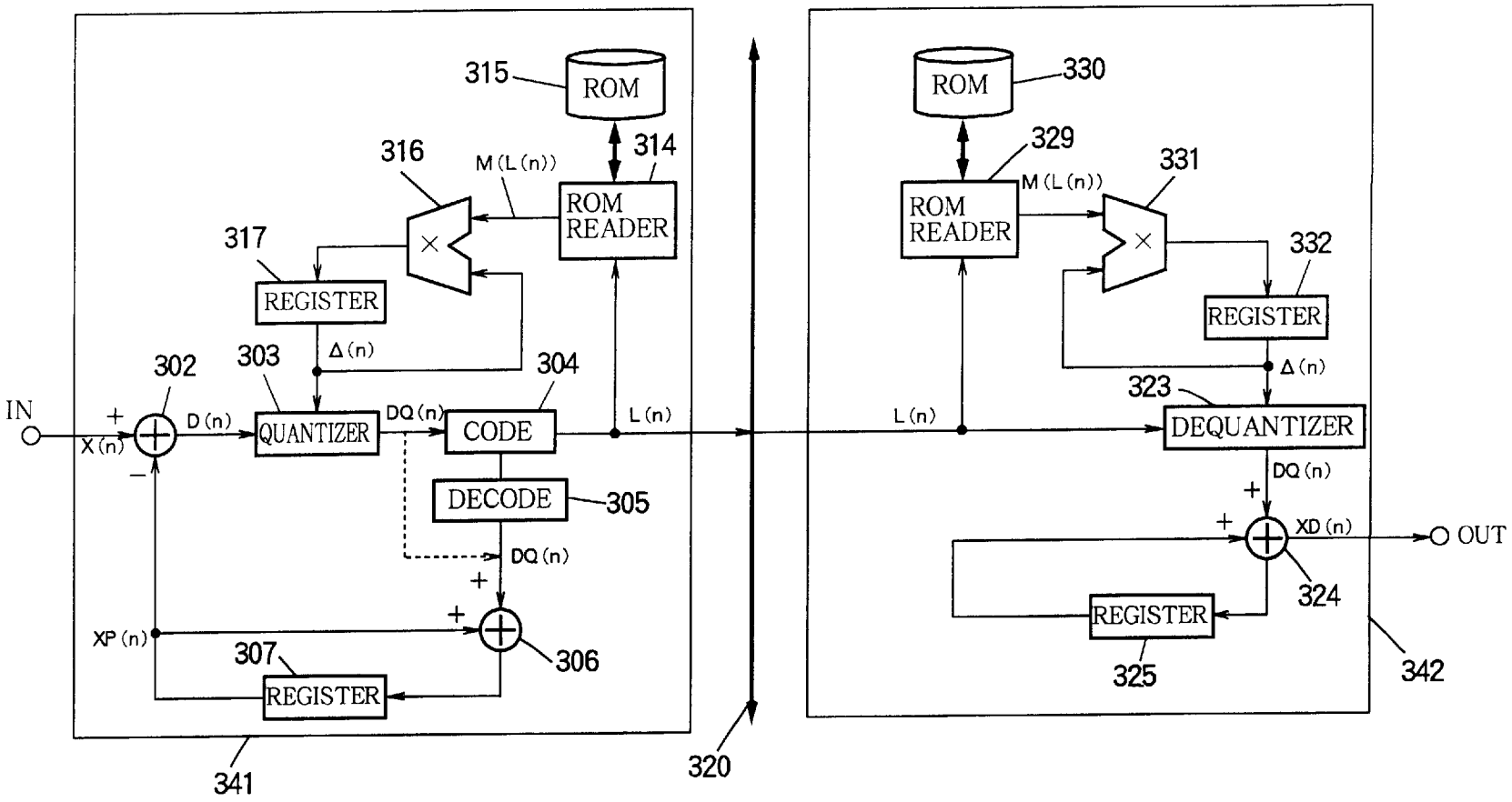
FIG. 5 PRIOR ART
FIG. 5 is a block diagram of a conventional ADPCM coder and decoder.

FIG. 5 shows the structure of the conventional four-bit and five-bit ADPCM coders and decoders employed in these evaluations, using the same reference numerals as in FIG. 1. The input signal is not divided into frames, so the sample values are denoted X(n) (n=0, 1, 2, . . . ). The predicted value XP(n) of the n-th sample is derived as follows in the coder 341.

$$XP(n)=XP(n-1)+DQ(n-1)$$

The output sample value XD(n), which is equal to XP(n+1), is obtained as follows in the decoder 342.

$$XD(n)=XD(n-1)+DQ(n)$$

In the four-bit ADPCM coder and decoder, ROMs 315 and 330 stored the same multiplier values as in the first embodiment, listed in Table 2. In the five-bit ADPCM coder and decoder, the coded samples values L(n) had five-bit values, and ROMs 315 and 330 stored the multiplier values M(L(n)) listed in Table 4.

TABLE 4

Multiplier ROM Data in Conventional Five-Bit ADPCM

| DQ(n) | L(n) | M(L(n)) |
|---|---|---|
| 31Δ(n)/16 | 01111 | 3.3 |
| 29Δ(n)/16 | 01110 | 3.0 |
| 27Δ(n)/16 | 01101 | 2.7 |
| 25Δ(n)/16 | 01100 | 2.4 |
| 23Δ(n)/16 | 01011 | 2.1 |
| 21Δ(n)/16 | 01010 | 1.8 |
| 19Δ(n)/16 | 01001 | 1.5 |
| 17Δ(n)/16 | 01000 | 1.2 |
| 15Δ(n)/16 | 00111 | 0.95 |
| 13Δ(n)/16 | 00110 | 0.95 |
| 11Δ(n)/16 | 00101 | 0.95 |
| 9Δ(n)/16 | 00100 | 0.95 |
| 7Δ(n)/16 | 00011 | 0.9 |
| 5Δ(n)/16 | 00010 | 0.9 |
| 3Δ(n)/16 | 00001 | 0.9 |
| Δ(n)/16 | 00000 | 0.9 |
| −Δ(n)/16 | 10000 | 0.9 |
| −3Δ(n)/16 | 10001 | 0.9 |
| −5Δ(n)/16 | 10010 | 0.9 |
| −7Δ(n)/16 | 10011 | 0.9 |
| −9Δ(n)/16 | 10100 | 0.95 |
| −11Δ(n)/16 | 10101 | 0.95 |
| −13Δ(n)/16 | 10110 | 0.95 |
| −15Δ(n)/16 | 10111 | 0.95 |
| −17Δ(n)/16 | 11000 | 1.2 |
| −19Δ(n)/16 | 11001 | 1.5 |
| −21Δ(n)/16 | 11010 | 1.8 |
| −23Δ(n)/16 | 11011 | 2.1 |
| −25Δ(n)/16 | 11100 | 2.4 |
| −27Δ(n)/16 | 11101 | 2.7 |
| −29Δ(n)/16 | 11110 | 3.0 |
| −31Δ(n)/16 | 11111 | 3.3 |

Figure 6:
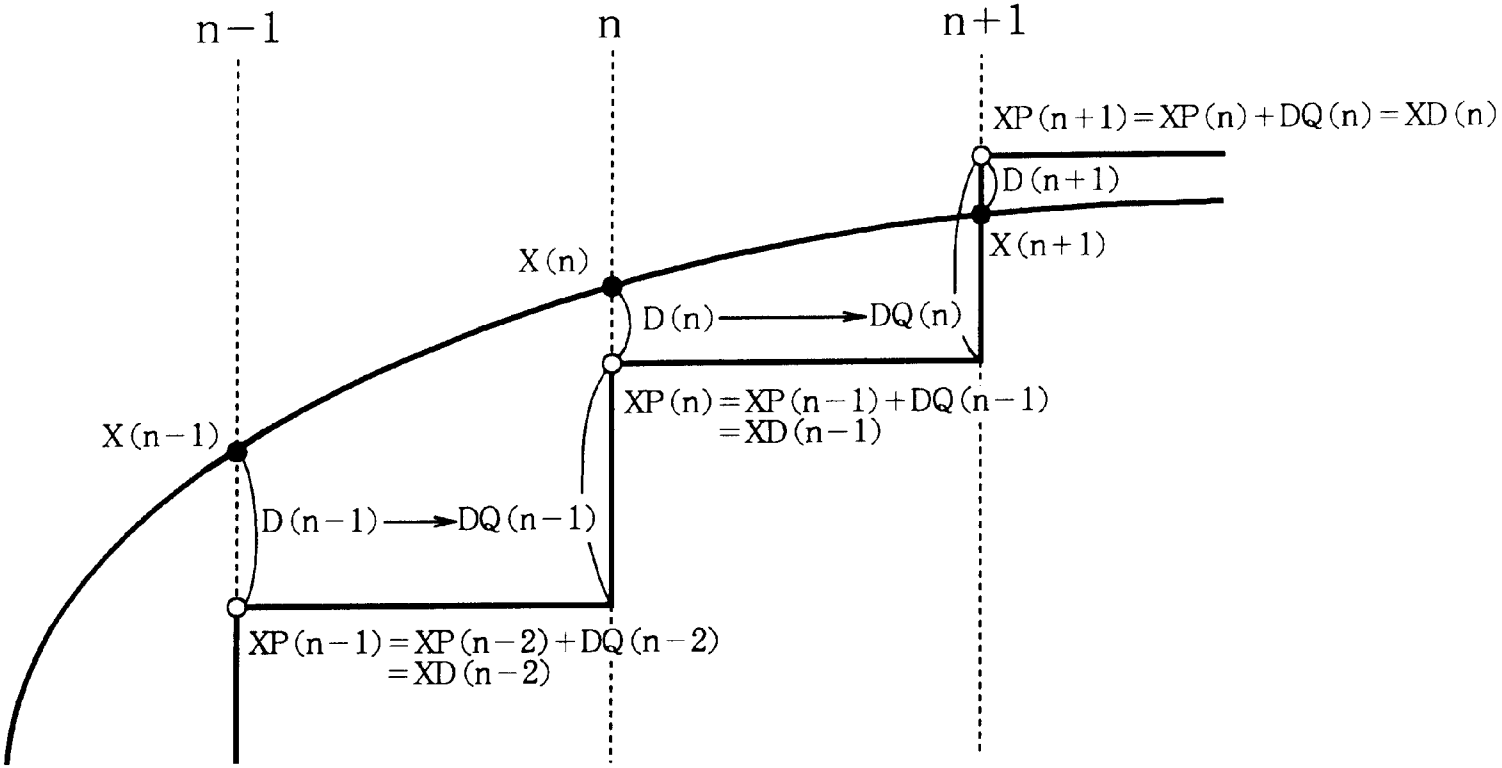
FIG. 6 is a waveform diagram illustrating the operation of the conventional ADPCM coder and decoder.

FIG. 6 illustrates the operation of the conventional ADPCM coder on three sample values X(n−1), X(n), and X(n+1). The predicted values XP(n−1), XP(n), and XP(n+1) are equal to the decoded output values XD(n−2), XD(n−1), and XD(n).

Figure 7:
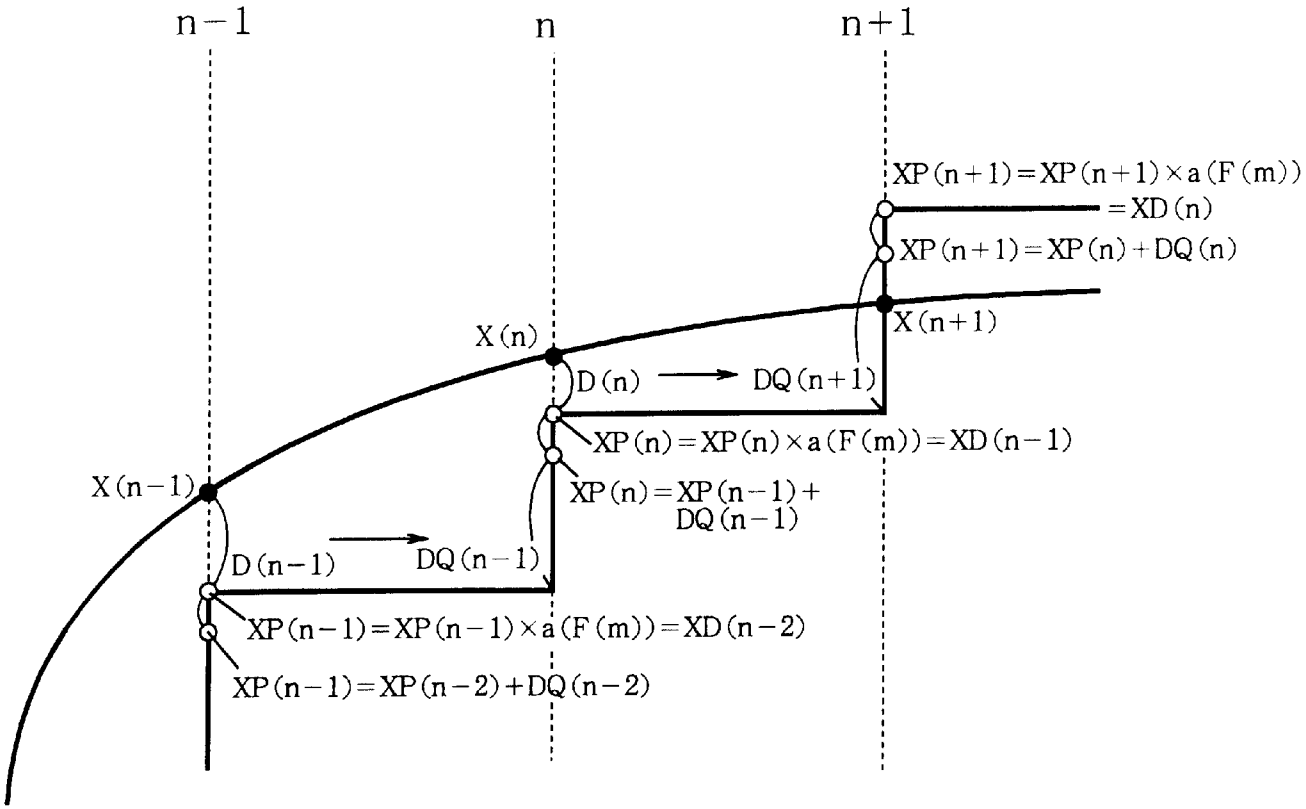
FIG. 7 is a waveform diagram illustrating the operation of the first embodiment.

FIG. 7 illustrates the operation of the first embodiment, using the symbol XP(n) to represent both the preliminary predicted value XP1(n) and the actual predicted value XP2(n), which is equal to the output value XD(n−1) in the decoder 321.

The number of samples per frame is not limited to ten, but can be varied according to the requirements of the communication channel or recording medium 320. The frame length, and the number of coefficients or number of address bits, can also be varied to optimize the performance of the first embodiment for a given bit rate. Experiments by the inventor indicate that the values in Table 5 are optimal for the bit rates shown.

TABLE 5

Optimal Frame Lengths and Numbers of Coefficients

| Bit Rate (bits/sample) | Frame Length (samples) | Number of Coefficients |
|---|---|---|
| 4.4 | 10 | 16 |
| 4.3 | 14 | 16 |
| 4.2 | 15 | 8 |
| 4.1 | 30 | 8 |

The first embodiment can also be varied by determining the maximum individual-sample quantization error in each frame, and selecting the coefficient value that minimizes this maximum quantization error. Details will be described in the second embodiment.

The initial values placed in registers B and D, and in registers E and F, can also be varied, but the values of eight and zero mentioned above are appropriate for the usual case in which the input signal has an initially low level.

The coefficient values are not limited to the values in Table 1, but it is desirable to use coefficients of the form $i/2^j$, where i and j are integers and j is relatively small, so that the multiplication operations can be carried out rapidly by bit shifting and addition.

The step-multiplier values M(L(m, n)) are not limited to the values in Table 2. The optimum multiplier values depend on the statistical properties of the input signal. The values shown in Table 2 were determined experientially, and are shown only as one example.

Next, the second embodiment will be described. Illustrating the second sub-aspect of the first aspect of the invention, the second embodiment processes each frame sixteen times, using a different step function each time, and selects the step function that yields the least maximum quantization error. The second embodiment does not multiply the predicted sample values XP(m, n) by a coefficient.

Figure 8:
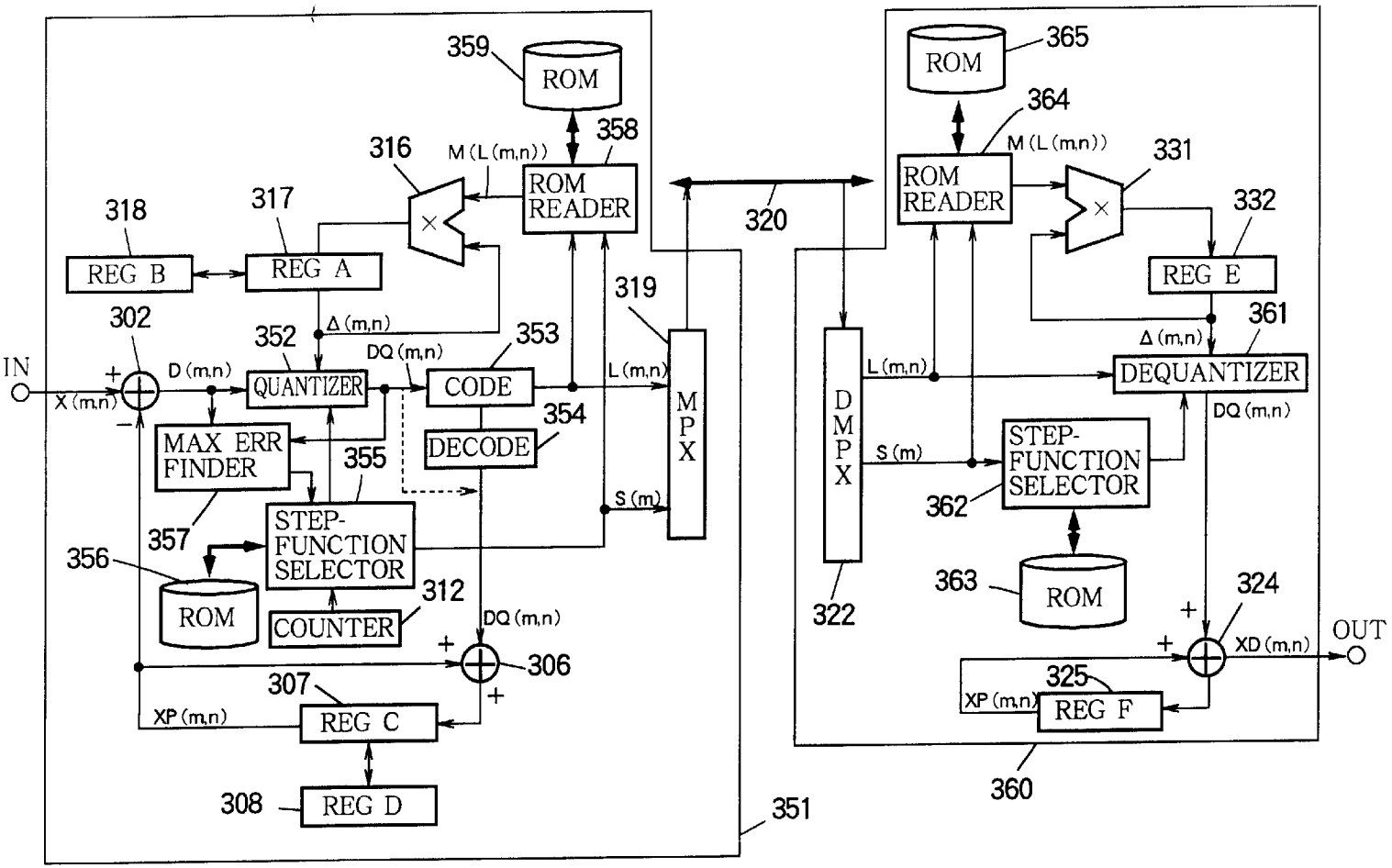
FIG. 8 is a block diagram of a coder and decoder, illustrating a second embodiment of the invention.

Referring to FIG. 8, in the coder 351, the quantizer 352, coding unit 353, and decoding unit 354 differ from the corresponding elements in the first embodiment in making use of a generic step function read by a step-function selector 355 from a step-function ROM 356. When frame processing is executed, a maximum error (MAX ERR) finder 357 determines the maximum quantization error for any one sample in the frame. After the frame processing has been repeated using all the step functions in the step-function ROM 356, the step-function selector 355 supplies the address S(m) of the optimal step function for the frame to the multiplexer 319. The ROM reader 358 reads multipliers from a multiplier ROM 359 that stores a separate multiplier value for each coded data value L(m, n) and each step function. Registers A, B, C, and D, adders 302 and 306, and multiplier 316 operate as in the first embodiment.

In the decoder 360, the coded data L(M, n) and address S(m) are demultiplexed by the demultiplexer 322. The coded data values L(M, n) are dequantized by a dequantizer 361, using a generic step function supplied from a step-function selector 362 and a step size supplied from register E. The step-function selector 362 obtains the step function from a step-function ROM 363 identical to the step-function ROM 356 in the coder 351, using S(m) as an address. L(m, n) is also supplied to a ROM reader 364 identical to the ROM reader 358 in the coder 351, which reads a multiplier from a multiplier ROM 365 identical to the multiplier ROM 359 in the coder 351. Registers E and F, adder 324, and multiplier 331 operate as in the first embodiment.

Figure 9:
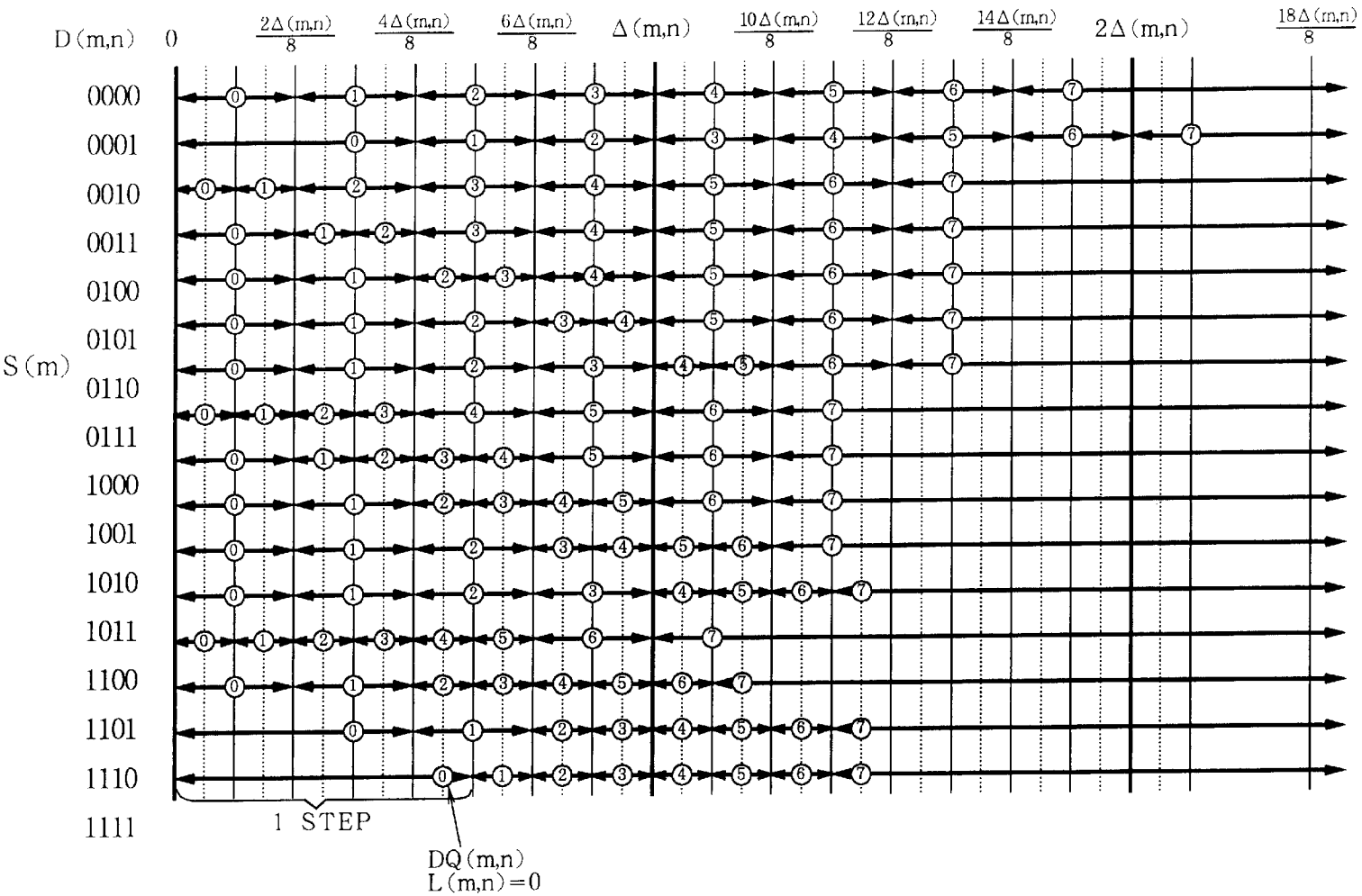
FIG. 9 is a chart illustrating the step functions used in the second embodiment.

FIG. 9 illustrates the contents of the step-function ROMs 356 and 363. The horizontal axis indicates sample values in terms of the step size Δ(m, n). The vertical axis indicates ROM addresses S(m). Each circle indicates the location of a quantized value DQ(m, n), the coded value L(m, n) of which is given in decimal notation inside the circle. The arrows extending right and left from the circle define the range of one step, within which all difference values D(m, n) are quantized to the value at the location of the circle. The step functions are generic in that a selected step function is used throughout one repetition of the coding of one frame, but the actual values of the step function depend on the step size Δ(m, n), which varies from sample to sample.

Only the positive half of the step function is shown. The negative steps are symmetrical to the positive steps. The step function at address S(m)=0010, for example, is given by the following equations.

$$DQ(m, n)=13\Delta(m, n)/8 \text{ if } 12\Delta(m, n)/8 \leqq D(m, n)$$

$$DQ(m, n)=(2i+1)\Delta(m, n)/8$$

if $2i\Delta(m, n)/8 \leqq D(m, n) < (2i+2)\Delta(m, n)/8$
where $1 \leqq i \leqq 5$ $$DQ(m, n)=(2i+1)\Delta(m, n)/16$$

if $2i\Delta(m, n)/16 \leqq D(m, n) < (2i+2)\Delta(m, n)/16$
where $-2 \leqq i \leqq 1$ $$DQ(m, n)=(2i+1)\Delta(m, n)/8$$

if $2i\Delta(m, n)/8 \leqq D(m, n) < (2i+2)\Delta(m, n)/8$
where $-6 \leqq i \leqq -2$ $$DQ(m, n)=-13\Delta(m, n)/8 \text{ if } D(m, n) < -12\Delta(m, n)/8$$

Compared with the step function employed in the first embodiment (stored at address 0000 in the second embodiment), the step function above sacrifices one positive and one negative outer step in order to provide smaller steps near the origin. Other step functions sacrifice more outer steps, or provide small steps at a distance from the origin. The step-function ROM 356 offers a selection of step functions suited for input signals with various statistical properties.

FIGS. 10A and 10B illustrate the contents of the multiplier ROMs 359 and 365. The multiplier values used when the step function with address S(m)=0000 is selected are the same as the multiplier values used in the first embodiment. For the other step functions, other sets of multiplier values are used.

The operation of the second embodiment will now be described with reference to the flowcharts in FIGS. 11 and 12.

Figure 11:
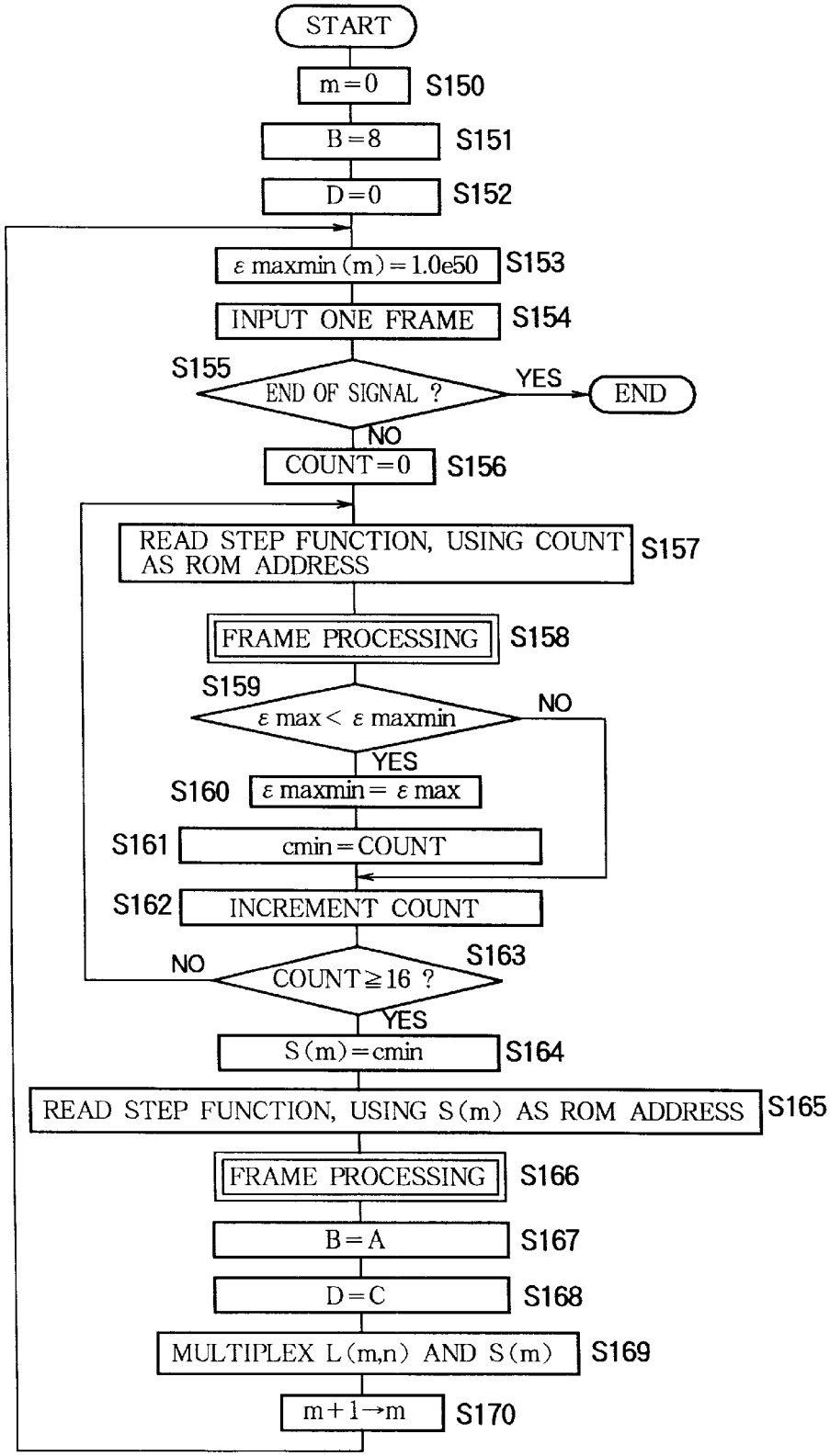
FIG. 11 is a flowchart illustrating the operation of the coder in FIG. 8.

Referring to FIG. 11, the processing of an input signal is preceded by initialization steps S150, S151, and S152, in which the frame number m is set to zero, and initial values of eight and zero are loaded into registers B and D, respectively, as in the first embodiment.

In the next step S153, a minimum-maximum error variable εmaxmin employed in the maximum error finder 357 is set to a large value, such as $10^{50}$, preferably larger than the largest possible quantization error that can occur at any one sample. The ten sample values of the current frame are input in step S154 and stored in an input buffer, as in the first embodiment, the process ending in step S155 if there is no frame to be input. Counter 312 is initialized to zero in step S156.

In step S157, the data defining one generic step function are read from the step-function ROM 356, using the counter value (count) as a ROM address. In step S158, the current frame is processed using this generic step function. The frame processing will be described later. During the frame processing, the maximum error finder 357 obtains a value εmax equal to the maximum quantization error that occurred at any sample in the frame, and compares this value εmax with the variable εmaxmin in step S159. If εmax is less than εmaxmin, then the value of εmaxmin is changed to εmax in step S160, and the step-function selector 355 sets an internal count variable cmin to the current count value (count) in step S161. If εmax is not less than εmaxmin, then steps S160 and S161 are skipped.

Next, counter 312 is incremented in step S162 and compared with sixteen in step S163. If the count value is less than sixteen, the process returns to step S157.

When the input frame has been processed sixteen times, producing a 'Yes' decision in step S163, the processing advances to step S164, in which the address S(m) output by the step-function selector 355 is set to the current value of the variable cmin. The corresponding step-function data are read from the step-function ROM 356 in step S165, and used to process the same frame once more in step S166, to obtain the coded data L(M, n) supplied to the multiplexer 319. Then the contents of registers A and C are saved into registers B and D in steps S167 and S168, and the coded data L(m, n) and address information S(m) are multiplexed onto the communication channel or recording medium 320 in step S169. In step S170, the frame number m is incremented, and the procedure returns to step S153 to begin processing the next frame.

Figure 12:
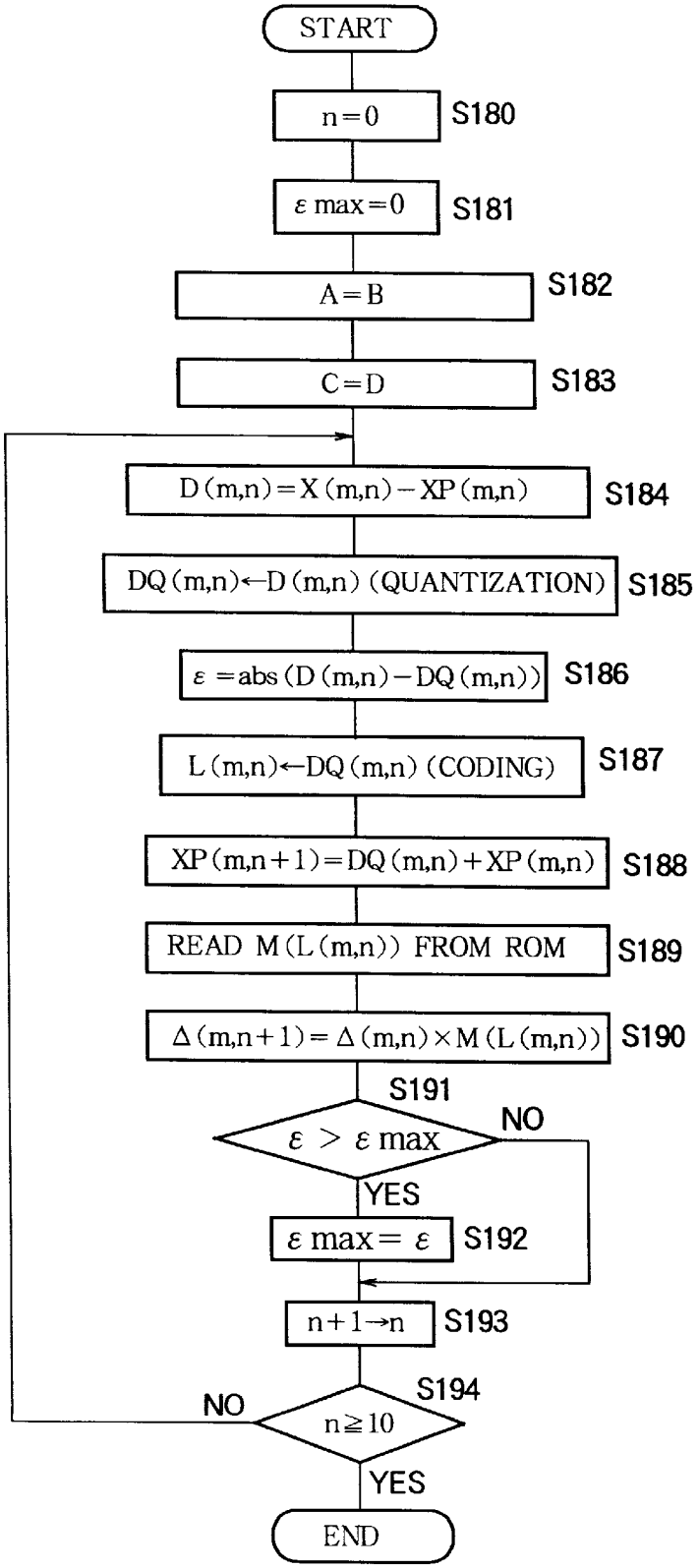
FIG. 12 is a flowchart illustrating the frame processing in FIG. 11.

The frame processing carried out in steps S158 and S166 in FIG. 11 is illustrated in FIG. 12. In steps S180 to S183, the sample number n and maximum quantization error variable εmax are both initialized to zero, and the contents of registers B and D are loaded into registers A and C. In step S184, the predicted value XP(m, n) of the current sample is subtracted from the actual sample value X(m, n) to obtain the difference value D(m, n). In step S185, D(m, n) is quantized to obtain the quantized difference DQ(m, n), using the generic step function supplied from the step-function ROM 356 and the step size Δ(m, n) supplied from register A.

In step S186, a variable α is set to the absolute difference between the actual difference value D(m, n) and the quantized difference DQ(m, n). This absolute difference ε is the quantization error of sample X(m, n).

In step S187, the quantized value DQ(m, n) is converted to a four-bit coded value L(m, n) using the generic step function and step size as shown in FIG. 9.

In step S188, the predicted value XP(m, n+1) of the next sample is obtained by adding DQ(m, n) to the current prediction XP(m, n), and the result is stored in register C.

In step S189, a multiplier value M(L(m, n)) is read from the multiplier ROM 359, using both L(m, n) and the value of counter 312 or S(m) as address information. For example, if L(m, n) is three (0011) and S(m) is zero (0000), then from FIGS. 10A and 10B, the multiplier value is 0.9. In step S190, the current quantization step size Δ(m, n) is multiplied by the multiplier value to obtain the next step size Δ(m, n+1), which is stored in register A.

In step S191, the quantization error ε of the current sample is compared with the maximum quantization error εmax that has occurred so far in the frame. If ε is greater than εmax, then εmax is changed to the value of ε in step S192. If ε is not greater than εmax, then step S192 is skipped.

The sample number n is then incremented in step S193, and compared with the number of samples in the frame (ten)

in step S194. The frame processing procedure returns to step S184 if n is less than ten, and ends when n is ten.

For each step function stored in the step-function ROM 356, the process in FIG. 12 finds the maximum quantization error $\epsilon$max in the current frame. The process in FIG. 11 then selects the step function that minimizes this maximum quantization error $\epsilon$max. The minimum $\epsilon$max value is $\epsilon$maxmin, which becomes the maximum quantization error in the final coding of the frame in step S166. To eliminate unnecessary processing, the process in FIG. 12 is preferably terminated whenever $\epsilon$ is greater than the current value of $\epsilon$maxmin.

In the decoding process performed by the decoder 360, each frame is dequantized using the generic step function designated by the address information S(m) appended to the coded sample data for the frame. This address S(m) is also used in obtaining multiplier values from the multiplier ROM 365. The predicted values are not multiplied by coefficients, so the decoding equations become the following.

$$XD(m, n)=XD(m, n-1)+DQ(m, n) \text{ if } 0<n$$

$$XD(m, 0)=XD(m-1, 9)+DQ(m, 0)$$

Aside from these differences, the decoder 360 operates as in the first embodiment.

The bit rate of the coded data is 4.4 bits per sample, as in the first embodiment. The second embodiment was evaluated objectively by the same method as the first embodiment and compared with conventional four-bit and five-bit ADPCM coders, with the results shown in Table 6.

TABLE 6

Comparison of Coder Performance

| Bits per Sample | segSNR |
|---|---|
| 5.0 (conventional coder) | 46.9 dB |
| 4.4 (second embodiment) | 48.2 dB |
| 4.0 (conventional coder) | 42.0 dB |

The second embodiment bettered the average segmental signal-to-noise ratio of the conventional four-bit ADPCM coder by 6.2 dB, and that of the conventional five-bit ADPCc coder by 1.3 dB. These results were obtained with a frame length of ten samples. If longer frames are used, excellent performance can also be obtained with lower bit rates, as shown in Table 7. With thirty-sample frames, for example, the second embodiment still outperforms the conventional five-bit ADPCM coder, while producing only 3.3% more coded data than the conventional four-bit ADPCM coder.

TABLE 7

Performance of 2nd Embodiment at Other Frame Lengths

| Bit Rate (bits/sample) | Frame Length (samples) | Signal-to-Noise Ratio (average segSNR) |
|---|---|---|
| 4.2 | 20 | 47.6 dB |
| 4.13 | 30 | 47.4 dB |

In subjective music listening tests, the second embodiment was judged to perform substantially as well as a conventional five-bit ADPCM coder, greatly reducing the high-frequency quantization noise that was noticeable with a conventional four-bit ADPCM coder.

The multiplier values shown in FIGS. 10A and 10B were determined experientially, and are shown only as an example. The second embodiment can be practiced with other multiplier values. The second embodiment can also be practiced with generic step functions other than the ones shown in FIG. 9, or with a subset of these step functions, although experiments by the inventor indicate that the step functions in FIG. 9 lead to favorable signal-to-noise ratios.

The second embodiment can also be varied by selecting the optimal step function according to the total quantization error in each frame, as in the first embodiment. In listening experiments, however, use of the total quantization error as a selection criterion in the second embodiment was found to produce audible artifacts due to large quantization errors occurring at isolated samples. Minimization of the maximum quantization error appears preferable in the second embodiment.

The first and second embodiments can both be varied by storing the coding results obtained from each repetition of the coding of each frame, so that the coding results producing the least quantization error can be output without having to repeat the coding process yet again.

Next, a third embodiment, illustrating the second aspect of the invention, will be described.

Like the preceding embodiments, the third embodiment uses repeated coding to reduce quantization noise with relatively little increase in code size. Unlike the preceding embodiments, the third embodiment does not divide the input signal into frames, so the input samples will be denoted X(n).

Figure 13:
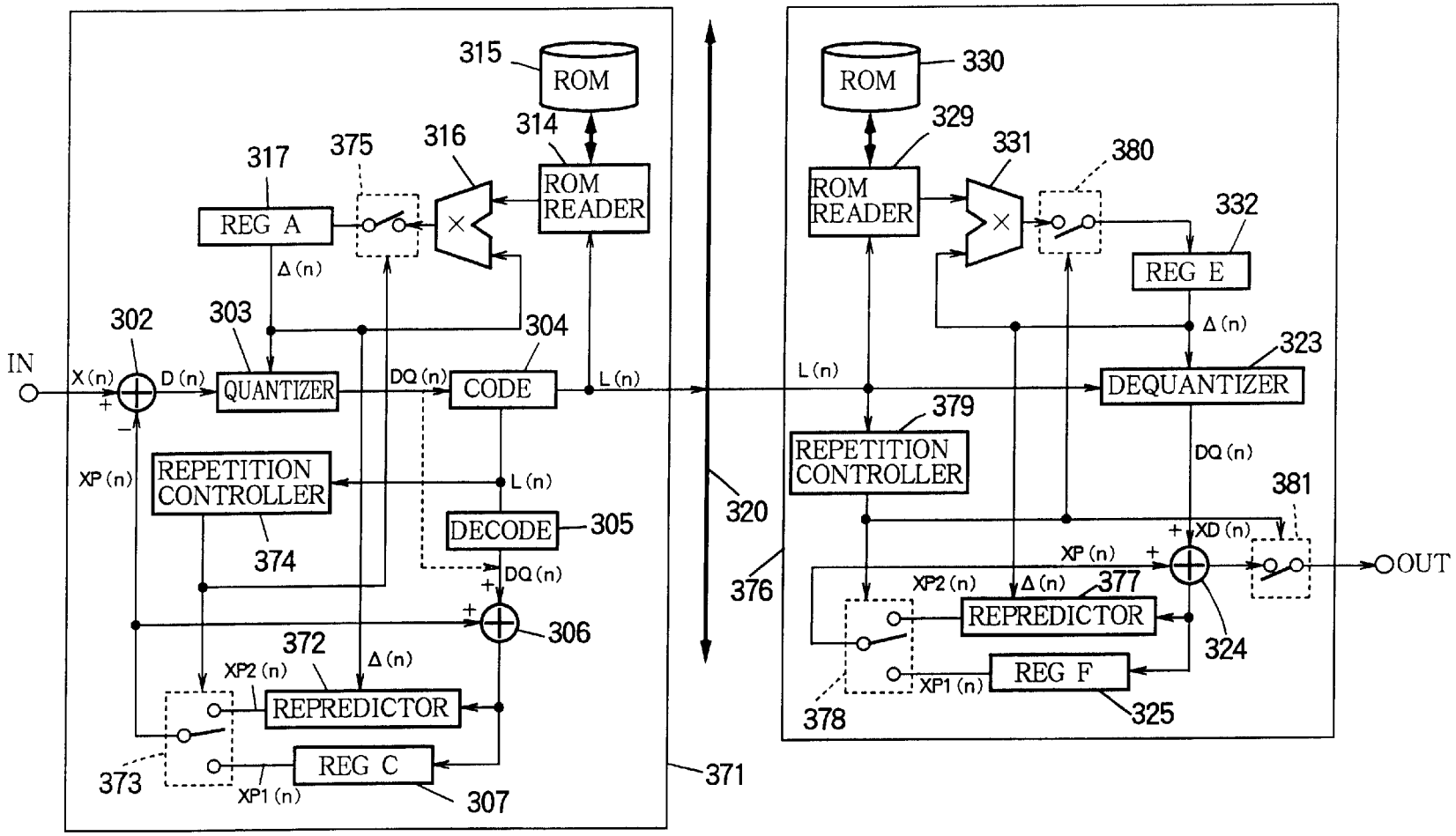
FIG. 13 is a block diagram of a coder and decoder, illustrating a third embodiment of the invention.

Referring to FIG. 13, in the coder 371, input samples X(n) are processed by adders 302 and 306, a quantizer 303, a coding unit 304, and a decoding unit 305 that are similar to the corresponding elements in the first embodiment. The output of adder 306 is supplied to both register C 307 and a repredictor 372. The repredictor 372 adjusts the output of adder 306 by $\Delta(n)/8$. A data selector 373 selects either the contents XP1(n) of register C or the output XP2(n) of repredictor 372 for use as the predicted value XP(n) that adder 302 subtracts from the sample value X(n). The data selector 373 is controlled by a repetition controller 374 according to the coded data L(n) output by the coding unit 304. The repetition controller 374 also controls a switch 375 inserted between the multiplier 316 and register A 317. There are also a ROM reader 314 and multiplier ROM 315, which operate as in the first embodiment.

The decoder 376 has a repredictor 377, a data selector 378, a repetition controller 379, and a switch 380 which are identical to the repredictor 372, data selector 373, repetition controller 374, and switch 375 in the coder 371. The decoder 376 also has a dequantizer 323, adder 324, register F 325, ROM reader 329, multiplier ROM 330, multiplier 331, and register E 332 that are identical to the corresponding elements in the first embodiment, and a switch 381 that controls output of the decoded data XD(n) obtained by adder 324.

Repeated coding in the third embodiment is controlled by the repetition controller 374. When the coded data value L(n) ends in '111,' the repetition controller 374 opens switch 375, has the data selector 373 select XP2(n), and causes the same input sample to be coded again. At other times, the repetition controller 374 closes switch 375 and has the data selector 373 select XP1(n), and the coder 371 operates in the same way as the conventional four-bit ADPCM coder in FIG. 5.

Repeated decoding is controlled similarly by the repetition controller 379 in the decoder.

Table 8 summarizes the operation of the data selectors 373 and 378 and switches 375, 380, and 381 in the coder 371 and decoder 376, and indicates when the quantization step size is updated. Table 9 indicates when the coding of the same sample is repeated in the coder, and describes the prediction process in the coder. Table 10 indicates when the decoded data are output from the decoder, and describes the prediction process in the decoder.

TABLE 8

Coder and Decoder Operations (3rd embodiment)

| L (n) | Selected Data | Switches | Step size |
|---|---|---|---|
| 0111 or 1111 | XP2 (n) | All open | Not updated |
| Other value | XP1 (n) | All closed | Updated |

TABLE 9

Coder Operations (3rd embodiment)

| L (n) | Prediction | Repeated Coding |
|---|---|---|
| 0111 or 1111 | XP (n) = XP2 (n) | Yes |
| Other value | XP (n + 1) = XP1 (n) | No |

TABLE 10

Decoder Operations (3rd embodiment)

| L (n) | Prediction | Output of XD (n) |
|---|---|---|
| 0111 or 1111 | XP (n + 1) = XP2 (n) | No |
| Other value | XP (n + 1) = XP1 (n) | Yes |

The preliminary values XP1(n) and XP2(n) are given by the following equations in both the coder and the decoder.

$$XP1(n)=XP(n)+DQ(n)$$

$$XP2(n)=XP1(n)-\Delta(n)/8=XP(n)+DQ(n)-\Delta(n)/8$$

if DQ(n)>0

$$XP2(n)=XP1(n)+\Delta(n)/8=XP(n)+DQ(n)+\Delta(n)/8$$

if DQ(n)<0

The reason for adjusting XP2(n) by Δ(n)/8 is to ensure that when the same sample is coded repeatedly, all of the coded values have the same sign. This enables the bit rate of the coded data to be reduced by outputting the sign bit only once, instead of once for each repeated coding.

The coded values '0111' and '1111' that cause repeated coding correspond to the outermost steps of the quantization step function, and occur under the following conditions.

$$L(n)=\text{'0111'} \text{ if } X(n)\geqq XP(n)+14\Delta(n)/8$$

$$L(n)=\text{'1111'} \text{ if } X(n)<XP(n)-14\Delta(n)/8$$

When L(n) is '0111' (seven, a positive value), for example, the quantized difference DQ(n) is 15Δ(n)/8. The first preliminary value XP1(n) is therefore:

$$XP1(n)=XP(n)+15\Delta(n)/8$$

If the sample were to be coded again using XP1(n) as a new predicted value, then the sample value X(n) might be less than the new predicted value, causing the new quantized difference and coded data to be negative instead of positive. This reversal of sign would occur for values of X(n) in the following range.

$$XP(n)+14\Delta(n)/8\leqq X(n)<XP(n)+15\Delta(n)/8$$

Reducing the new predicted value from XP(n)+15Δ(n)/8 to XP(n)+14Δ(n)/8 ensures that the sample value X(n) is equal to or greater than the new predicted value, even when X(n) is in the above range, so no sign reversal can occur.

Operation of the third embodiment will now be described with reference to the flowcharts in FIGS. 14 and 15.

Figure 14:
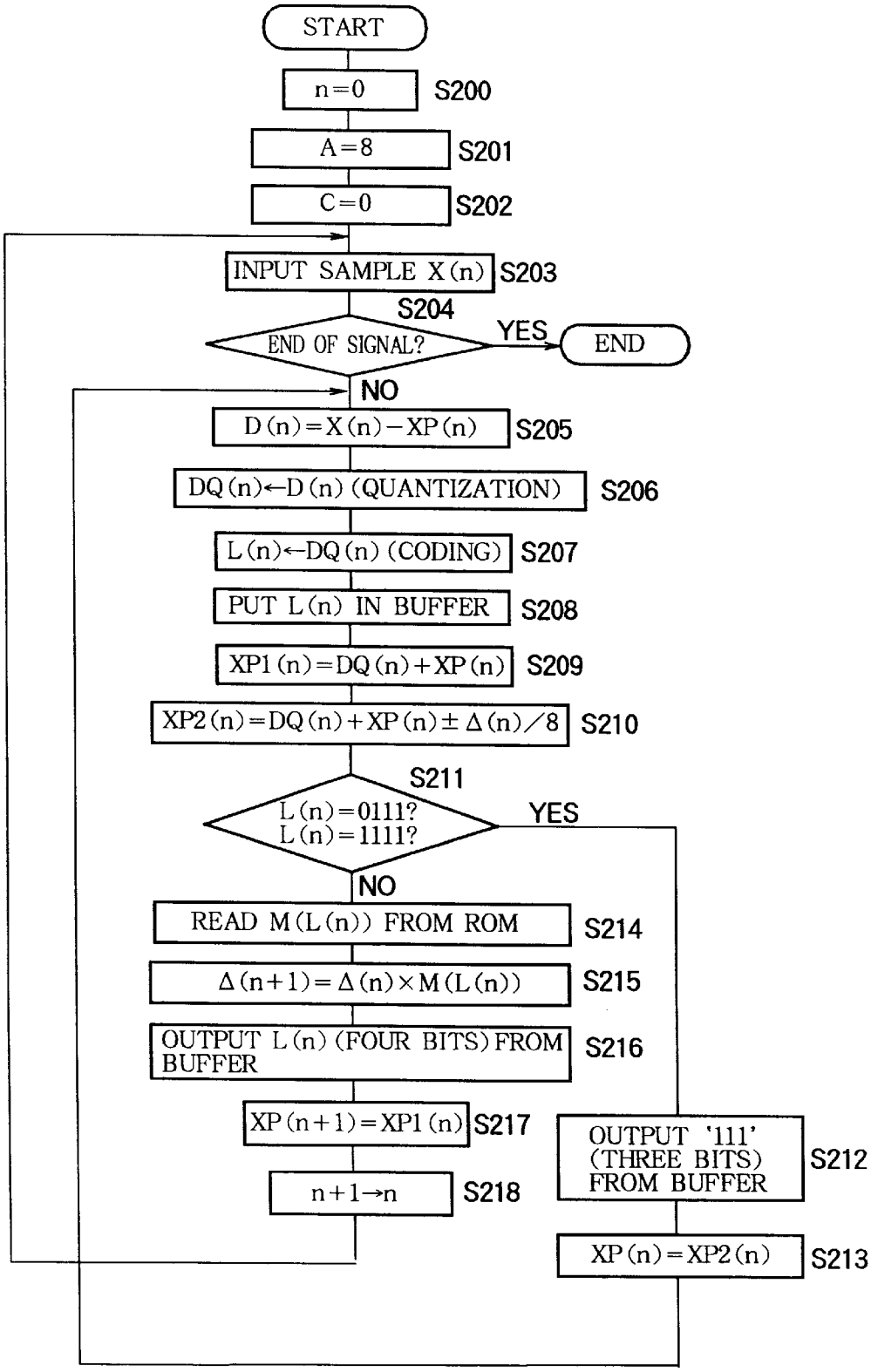
FIG. 14 is a flowchart illustrating the operation of the coder in FIG. 13.

FIG. 14 illustrates the operation of th e coder 371. In steps S200, S201, and S202, the symbol number n is initialized to zero, and registers A and C are initialized to eight and zero, respectively. One sample value X(n) is input in step S203. If there is no sample value to input, this is detected in step S204 and the coding process ends.

In step S205, adder 302 subtracts the predicted sample value XP(n) from the input sample value X(n) to obtain the difference value D(n). This value is quantized by the quantizer 303 in step S206 to obtain DQ(n), which is coded by the coding unit 304 in step S207 to obtain the coded data L(n). In step S208, L(n) is placed in a buffer preliminary to transmission or storage.

In step S209, adder 306 adds DQ(n) to the predicted value XP(n) to obtain a first preliminary value XP1(n), which is placed in register C. In step S210, if DQ(n) is positive, the repredictor 372 subtracts one-eighth the step size Δ(n)/8 from the sum of DQ(n) and XP(n) to obtain a second preliminary value XP2(n). If DQ(n) is negative, the repredictor 372 adds one-eighth Δ(n)/8 to the sum of DQ(n) and XP(n) to obtain XP2(n). The repredictor 372 obtains the step size Δ(n) from register A.

In step S211, the repetition controller 374 tests the coded value L(n) to determine whether L(n) is equal to '0111' or '1111.' If so, then in step S212, the three least significant bits '111' are output from the above-mentioned buffer to the communication channel or recording medium 320, and in step S213, the predicted sample value XP(n) is changed to the second preliminary value XP2(n). The process then returns to step S205 to subtract the new predicted value XP(n) from the same sample value X(n) and repeat the coding of X(n). The coding of X(n) is repeated until a coded value L(n) different from '0111' and '1111' is obtained.

When L(n) is not equal to '0111' or '1111,' the ROM reader 314 reads the corresponding step multiplier M(L(n)) from the multiplier ROM 315 in step S214, and the multiplier 316 multiplies the step size Δ(n) by M(L(n)) in step S215 to obtain the step size Δ(n+1) for the next sample. Switch 375 is closed, so this step size Δ(n+1) is stored in register A. All four bits of the coded data value L(n) are then output from the buffer in step S216, and the predicted value XP(n+1) of the next sample is set equal to the first preliminary value XP(n) in step S217. In step S218, the sample number n is incremented, and the process returns to step S203 to input the next sample.

The order of output in step S216 is little-endian, the least significant bit being output first.

Figure 15:
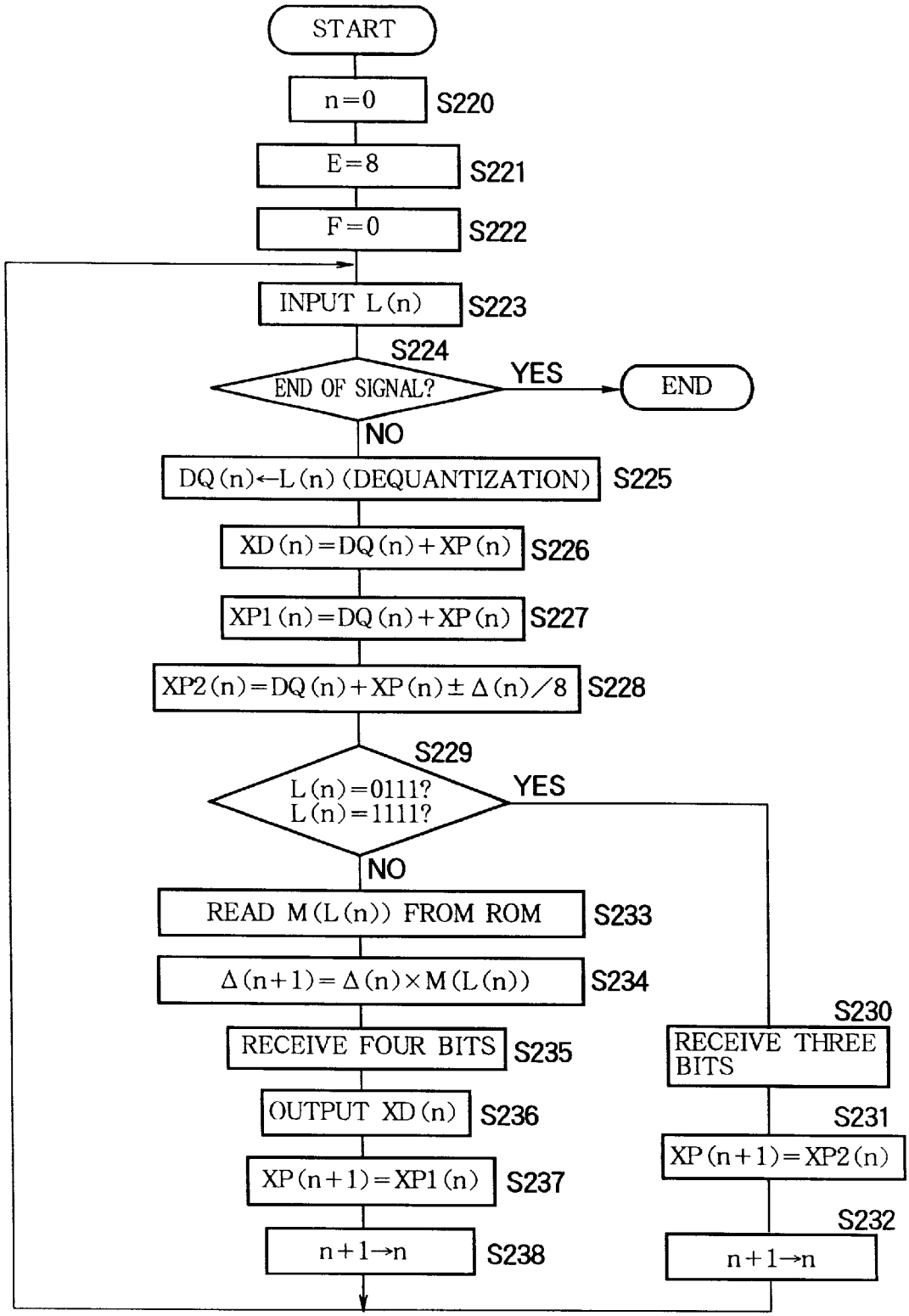
FIG. 15 is a flowchart illustrating the operation of the decoder in FIG. 13.

FIG. 15 illustrates the decoding process, which is quite similar to the coding process. In steps S220, S221, and S222, the code-word number n is initialized to zero, and registers E and F are initialized to eight and zero, respectively. One coded value L(n) is input in step S223. If there is no coded value to input, this is detected in step S224 and the decoding process ends.

In step S225), the dequantizer 323 dequantizes the coded value L(n) to obtain the dequantized difference value DQ(n). In step S226, adder 324 adds DQ(n) to the predicted value XP(n) to obtain a decoded output value XD(n). In step S227, the sum of DQ(n) and XP(n) is also placed in register F as a first preliminary value XP1(n). In step S228, the repredictor 377 subtracts one-eighth the step size Δ(n)/8 from the sum of DQ(n) and XP(n) if DQ(n) is positive, or adds Δ(n)/8 to the sum of DQ(n) and XP(n) if DQ(n) is negative, to obtain a second preliminary value XP2(n).

In step S229, the repetition controller 379 tests the three least significant bits of the coded value L(n), which are the first three received bits of L(n), to determine whether L(n) is equal to '0111' or '1111.' If so, then the three received three bits '111' constitute the entire value of L(n), and in step S230, a bit pointer in a receive buffer (not visible) is adjusted to indicate that the next received bit is the first bit of the next coded data value. In step S231, the predicted sample value XP(n) is changed to the second preliminary value XP2(n). In step S232, the code-word number n is incremented, and the process returns to step S223 to receive the next coded value. Switch 381 is opened, because the least significant coded data bits were '111,' blocking output of the decoded data XD(n) obtained in step S226.

When the least significant bits of L(n) are not equal to '111,' the ROM reader 329 reads the step multiplier M(L(n)) from the multiplier ROM 330 in step S233, and the multiplier 331 multiplies the step size Δ(n) by M(L(n)) to obtain the step size Δ(n+1) for the next coded data value L(n+1) in step S234. Switch 380 is closed, so Δ(n+1) is stored in register E. In step S235, the bit pointer in the receive buffer is set to indicate that code word L(n) was four bits long. The decoded data value XD(n) is then output through switch 381 in step S236, the predicted value XP(n+1) of the next sample is set equal to the first preliminary value XP1(n) in step S237, the code-word number n is incremented in step S238, and the process returns to step S223 to input the next coded data.

In step S225, when a three-bit coded value '111' is received, the dequantizer 323 does not know the value of the sign bit, but can find the sign bit by looking ahead in the receive buffer. If necessary, execution of step S225 and the steps dependent thereon can be deferred until the sign bit has been received.

When, for example, the input sample value X(n) lies in the rightmost step of the quantization step function, the value of X(n) has no upper limit. The difference D(n) between X(n) and the predicted value XP(n) is therefore also unlimited, and the quantization error, which is the absolute difference between D(n) and 15Δ(n)/8, may be arbitrarily large. With conventional ADPCM coding, overload noise can occur. The third embodiment eliminates overload noise by adjusting the predicted value XP(n) until the difference between the sample value XP(n) and predicted value is equal to or less than 14Δ(n)/8. The quantization error is then limited to Δ(n)/8.

The performance of the third embodiment was compared objectively with the performance of a conventional four-bit ADPCM coder by calculating an average segmental signal-to-noise ratio. The input signal was a music signal of the type used for checking the high-frequency reproduction limits of audio systems. The results are shown in Table 11.

TABLE 11

Comparison of Coder Performance

| Bits per Sample | segSNR |
|---|---|
| 4.0 (conventional coder) | 16.1 dB |
| 4.15 (third embodiment) | 17.9 dB |

The third embodiment improved the signal-to-noise ratio by 1.8 dB while increasing the bit rate by only about 0.15 bits per sample, or 3.75%. Analysis showed that only about 2.73 of the samples had been coded more than once. The improvement was thus attained with much less repeated coding than in the first and second embodiments.

Other music samples, in which conventional four-bit ADPCM coding was known to produce audible overload noise, were tested subjectively. The third embodiment was found to reduce the noise effects; the audio quality of the output of the third embodiment was judged to be good.

The third embodiment can be modified in various ways. In one variation, when the same input sample is coded repeatedly, the sign bit is output in the first coded value instead of the last coded value, so that the decoder does not have to look ahead in the received data to find the sign bit.

The coder can also be modified to output all four bits of coded data L(n) even when the four bits are '1111' or '0111,' so that all code words have the same length. In this case, the second preliminary value XP2(n) can also be modified as follows, to reduce the likelihood that another coding repetition will be needed:

$$XP2(n)=XP(n)+28\Delta(n)/8 \text{ if } 14\Delta(n)/8 \leqq D(n)$$

$$XP2(n)=XP(n)-28\Delta(n)/8 \text{ if } D(n)<-14\Delta(n)/8$$

The third embodiment can also be implemented by altering the step functions and ROM data, instead of using data selectors 373 and 378 and switches 375 and 380. Specifically, the quantized values DQ(n) of the outermost steps can be altered from ±15Δ(n)/8 to ±14Δ(n)/8 if three-bit coding of these steps is used, or to ±28Δ(n)/8 if four-bit coding is used, and unity multipliers can be stored in ROMs 315 and 330 for L(n) values of '0111' and '1111.' In this case, the repetition controller 374 in the coder only has to decide when to repeat the coding of a sample, and the repetition controller 379 in the decoder only has to control the output switch 381.

The invention has been described in relation to adaptive differential pulse-code modulation (ADPCM), but can be practiced in other types of differential coding as well, including types that use more complex methods of predicting the next sample value, with or without modification of the quantization step size.

The invention can be practiced in hardware, in software, or in a combination of hardware and software.

Variations of all of the above embodiments have already been pointed out, but those skilled in the art will recognize that further variations are possible within the scope of the invention as claimed below.

What is claimed is:

1. A coding method comprising the steps of:

(a) receiving successive sample values of an audio signal;

(b) calculating a predicted value of a current sample value among the successive sample values in said audio signal;

(c) calculating a difference between said current sample value and said predicted value;

(d) quantizing said difference, obtaining a quantized value;

(e) coding said quantized value, obtaining coded data;

(f) calculating a predicted value of a next sample value among the successive sample values in said audio signal from the predicted value and the quantized value of said current sample value; and (g) repeating said steps (b) to (f) for said current sample value, using at least one different predicted value in said step (b).

2. The method of claim 1, wherein said sample values are grouped into frames, and said step (g) repeats the coding of each frame at least once by repeating said steps (b) to (f) at least once for all of the sample values in the frame, and further comprising the steps of:

(h) calculating a frame quantization error for each repetition of the coding of each said frame; and (i) outputting the coded data produced in one repetition of the coding of each said frame, said one repetition minimizing the frame quantization error calculated in said step (h).

3. The method of claim 2, wherein said step (h) calculates a total quantization error of all of the sample values in each said frame as said frame quantization error.

4. The method of claim 2, wherein said step (h) calculates a maximum individual-sample quantization error in each said frame as said frame quantization error.

5. The method of claim 2, wherein said step (f) comprises taking a sum of said predicted value and said quantized value and multiplying said sum by a coefficient, and further comprising the step of:

(j) selecting said coefficient from a group of coefficients, the selected coefficient being used throughout one repetition of the coding of said frame, different coefficients being selected for different repetitions of the coding of said frame.

6. The method of claim 2, wherein said step (d) comprises using a step function to quantize said difference, and further comprising the step of:

(k) selecting said step function from a group of step functions, the selected step function being used throughout one repetition of the coding of said frame, different step functions being selected for different repetitions of the coding of said frame.

7. The method of claim 1, wherein said step (g) is carried out only when said coded data represent a maximum absolute quantized value.

8. The method of claim 7, wherein said predicted value and said different predicted value differ by less than said maximum absolute quantized value, forcing all of the coded data obtained from all repetitions of said steps (b) to (f) for said current sample value to have identical sign bits.

9. The method of claim 8, further comprising the step of:

(l) removing said sign bits from the coded data obtained in all but one of said repetitions of said steps (b) to (f) for each said sample value.

10. A coder, comprising:

an input terminal receiving an audio signal having sample values grouped into frames;

a subtractor coupled to said input terminal, said subtractor taking a difference between a current sample value in said audio signal and a predicted value of said current sample value, thereby obtaining a difference value;

a quantizing and coding unit coupled to said subtractor, quantizing and coding said difference value, thereby obtaining a quantized value and coded data representing said quantized value;

an error calculator coupled to said quantizing and coding unit, calculating a quantization error for each frame of said sample values;

a predictor coupled to said quantizing and coding unit, using said quantized value, the predicted value of said current sample value, and a coefficient to calculate a predicted value of a next sample value in said audio signal; and a coefficient selector coupled to said predictor, providing said coefficient to said predictor, causing said predictor and said quantizing and coding unit to code each said frame repeatedly using different values of said coefficient, selecting a value of said coefficient that produces a least quantization error for said frame, causing said quantizing and coding unit to output the coded data produced using the selected value of said coefficient, and appending information identifying said selected value to the coded data output for said frame.

11. The coder of claim 10, wherein said error calculator calculates a total quantization error of all sample values in each said frame.

12. The coder of claim 10, wherein said error calculator calculates a maximum individual-sample quantization error in each said frame.

13. The coder of claim 10, wherein said predictor comprises:

an adder adding said quantized value to the predicted value of said current sample value, obtaining a preliminary sum;

a first preliminary register storing said preliminary sum;

a multiplier multiplying said preliminary sum by said coefficient, obtaining said predicted value of said next sample value; and a second preliminary register storing the preliminary sum calculated by said adder using the quantized value of a last sample value in each said frame, when said frame is coded using said selected value of said coefficient, the preliminary sum stored in said second preliminary register being reloaded into said first preliminary register for calculation by said multiplier of the predicted value of a first sample value in each said frame, each time said frame is coded.

14. The coder of claim 13, further comprising a step-size modifier coupled to said quantizing and coding unit, providing a quantization step size to said quantizing and coding unit, and modifying the quantization step size of said next sample value according to said coded data.

15. The coder of claim 14, wherein said step-size modifier comprises:

a first step-size register storing said quantization step size; and a second step-size register storing the quantization step size of a first sample value in each said frame, the quantization step size stored in said second step-size register being reloaded into said first step-size register each time said frame is coded.

16. A decoder for decoding the coded data and the appended information output by the coder of claim 10, comprising:

a dequantizer dequantizing said coded data, thereby obtaining a dequantized value for said current sample value;

an output predictor coupled to said dequantizer, calculating an output value for said current sample value from said dequantized value and a predicted output value of said current sample value, and calculating a predicted output value of said next sample value from the output value of said current sample value and the coefficient identified by said appended information.

17. The decoder of claim 16, further comprising a step-size modifier coupled to said dequantizer, providing a quantization step size to said dequantizer, and modifying the quantization step size of said next sample value according to said coded data.

18. A coder, comprising:

an input terminal receiving an audio signal having sample values grouped into frames;

a subtractor coupled to said input terminal, said subtractor taking a difference between a current sample value in said audio signal and a corresponding predicted value, thereby obtaining a difference value;

a quantizing and coding unit coupled to said subtractor, using a step function to quantize and code said difference value, thereby obtaining a quantized value and coded data representing said quantized value;

an error calculator coupled to said quantizing and coding unit, calculating a quantization error for each frame of said sample values;

a predictor coupled to said quantizing and coding unit, calculating a predicted value of a next sample value in said audio signal from the quantized value and the predicted value of said current sample value; and a step-function selector coupled to said quantizing and coding unit, providing said step function to said quantizing and coding unit, causing said predictor and said quantizing and coding unit to code each said frame repeatedly using different step functions, selecting a step function that produces a least quantization error for said frame, causing said quantizing and coding unit to output the coded data produced using the selected step function, and appending information identifying said selected step function to the coded data output for said frame.

19. The coder of claim 18, wherein said error calculator calculates a maximum individual-sample quantization error in each said frame.

20. The coder of claim 18, wherein said error calculator calculates a total quantization error of all sample values in each said frame.

21. The coder of claim 18, wherein said predictor comprises:

an adder adding said quantized value to the predicted value of said current sample value, obtaining said predicted value of said next sample value;

a first prediction register storing the predicted value obtained by said adder; and a second prediction register storing the predicted value of a first sample value in each said frame, the predicted value stored in said second prediction register being reloaded into said first prediction register each time said frame is coded.

22. The coder of claim 18, further comprising a step-size modifier coupled to said quantizing and coding unit, providing a quantization step size to said quantizing and coding unit, and modifying the quantization step size of said next sample value according to said coded data.

23. The coder of claim 22, wherein said step-size modifier comprises:

a first step-size register storing said quantization step size; and a second step-size register storing the quantization step size of a first sample value in each said frame, the quantization step size stored in said second step-size register being reloaded into said first step-size register each time said frame is coded.

24. A decoder for decoding the coded data and the appended information output by the coder of claim 18, comprising:

a dequantizer using the step function identified by said appended information to dequantize said coded data, thereby obtaining a dequantized value for said current sample value;

an output predictor coupled to said dequantizer, calculating an output value for said current sample value from said dequantized value and a predicted output value of said current sample value, said output value becoming the predicted output value of said next sample value.

25. The decoder of claim 24, further comprising a step-size modifier coupled to said dequantizer, providing a quantization step size to said dequantizer, and modifying the quantization step size of said next sample value according to said coded data.

26. A coder, comprising:

an input terminal receiving an audio signal having sample values grouped into frames;

a predictor calculating a predicted value of a current sample value in said audio signal;

a subtractor coupled to said input terminal and said predictor, taking a difference between aid current sample value and said predicted value, thereby obtaining a difference value;

a quantizing and coding unit coupled to said subtractor, quantizing and coding said difference value, thereby obtaining a quantized value and coded data representing said quantized value; and a repetition controller coupled to said quantizing and coding unit, causing said predictor, said subtractor, and said quantizing and coding unit to process said current sample value again, using a different predicted value of said current sample value, when said coded data represent a maximum absolute quantized value.

27. The coder of claim 26, wherein said predicted value and said different predicted value differ by less than said maximum absolute quantized value, forcing all of the coded data obtained from processing of said current sample value to have identical sign bits.

28. The coder of claim 27, wherein said quantizing and coding unit outputs only one sign bit in all of the coded data obtained from processing of said current sample value.

29. The coder of claim 26, wherein said predictor comprises:

an adder adding said quantized value to said predicted value, obtaining a first preliminary value;

a register storing said first preliminary value;

a repredictor modifying said first preliminary value, obtaining a second preliminary value; and a data selector coupled to said repetition controller, selecting said second preliminary value as said predicted value when said current sample value is repeatedly processed, and selecting said first preliminary value as the predicted value of a next sample value in said audio signal when said current sample value is not repeatedly processed.

30. The coder of claim 26, further comprising a step-size modifier coupled to said quantizing and coding unit, providing a quantization step size to said quantizing and coding unit, modifying the quantization step size of said next sample value according to said coded data, and leaving said quantization step size unchanged when said current sample value is repeatedly processed.

31. A decoder for decoding the coded data output by the coder of claim 26, comprising:

a dequantizer dequantizing said coded data, thereby obtaining a dequantized value for each coded data value;

an output predictor coupled to said dequantizer, calculating an output value from said dequantized value and a predicted output value, said output value being used as the predicted output value for a next coded data value; and a switch coupled to said output predictor, blocking output of said output value when said coded data represent said maximum absolute quantized value.

32. The decoder of claim 31, further comprising a step-size modifier coupled to said dequantizer, providing a quantization step size to said dequantizer, modifying the quantization step size of said next sample value according to said coded data, and leaving said quantization step size unchanged when said coded data represent said maximum absolute quantized value.

33. A coding method, comprising the steps of:

(a) providing a sequence of sample values derived from an analog information signal that carries information about a stimulus perceptible to a human sense organ;

(b) calculating a predicted value of a current sample value among the successive sample values in said information signal;

(c) calculating a difference between said current sample value and said predicted value;

(d) quantizing said difference, obtaining a quantized value;

(e) coding said quantized value, obtaining coded data;

(f) calculating a predicted value of a next sample value among the successive sample values in said information signal from the predicted value and the quantized value of said current sample value; and (g) repeating said steps (b) to (f) for said current sample value, using at least one different predicted value in said step (b).

* * * * *